US008981198B2

(12) United States Patent
Nakatani

(10) Patent No.: US 8,981,198 B2
(45) Date of Patent: Mar. 17, 2015

(54) STRINGED INSTRUMENT

(71) Applicant: Toru Nakatani, Fuchu (JP)

(72) Inventor: Toru Nakatani, Fuchu (JP)

( * ) Notice: Subject to any disclaimer, the term of this patent is extended or adjusted under 35 U.S.C. 154(b) by 0 days.

(21) Appl. No.: 13/862,741

(22) Filed: Apr. 15, 2013

(65) Prior Publication Data

US 2013/0269505 A1 Oct. 17, 2013

(30) Foreign Application Priority Data

Apr. 17, 2012 (JP) ..... 2012-093945
Oct. 25, 2012 (JP) ..... 2012-235579

(51) Int. Cl.
*G10H 3/18* (2006.01)
*G10H 3/26* (2006.01)
*G10H 3/24* (2006.01)

(52) U.S. Cl.
CPC ..... *G10H 3/185* (2013.01); *G10H 3/24* (2013.01); *G10H 2230/095* (2013.01)
USPC ..... 84/626; 84/662

(58) Field of Classification Search
USPC ..... 84/626, 662
See application file for complete search history.

(56) References Cited

U.S. PATENT DOCUMENTS 3,422,715 A 1/1969 Gambella et al.
4,236,433 A * 12/1980 Holland ..... 84/726
4,941,388 A * 7/1990 Hoover et al. ..... 84/726
5,292,999 A * 3/1994 Tumura ..... 84/728
5,523,526 A * 6/1996 Shattil ..... 84/728
5,585,588 A * 12/1996 Tumura ..... 84/726
5,883,318 A 3/1999 Deutsch
5,932,827 A * 8/1999 Osborne et al. ..... 84/726
6,211,671 B1 * 4/2001 Shattil ..... 324/225
6,570,078 B2 * 5/2003 Ludwig ..... 84/600
8,067,683 B2 * 11/2011 Meeks et al. ..... 84/622
8,314,322 B2 * 11/2012 Langberg ..... 84/723
8,519,250 B2 * 8/2013 Ludwig ..... 84/645
2002/0005108 A1 * 1/2002 Ludwig ..... 84/600
2002/0005111 A1 * 1/2002 Ludwig ..... 84/645
2002/0007723 A1 * 1/2002 Ludwig ..... 84/645
2002/0056358 A1 * 5/2002 Ludwig ..... 84/738
2002/0069749 A1 * 6/2002 Hoover et al. ..... 84/738
2004/0065187 A1 * 4/2004 Ludwig ..... 84/645
2004/0069125 A1 * 4/2004 Ludwig ..... 84/645
2004/0069126 A1 * 4/2004 Ludwig ..... 84/645
2004/0069127 A1 * 4/2004 Ludwig ..... 84/645
2004/0069128 A1 * 4/2004 Ludwig ..... 84/645

(Continued)

FOREIGN PATENT DOCUMENTS

JP 15-25102 U 4/1926
JP 4-60594 A 2/1992

(Continued)

*Primary Examiner* — David S. Warren
(74) *Attorney, Agent, or Firm* — Westermann, Hattori, Daniels & Adrian, LLP

(57) ABSTRACT

A stringed instrument includes a body, a string, a string exciting device and a bridge. The body supports the string, the string exciting device and the bridge. The string has a scale length determined by a distance between a first support point and a second support point. The string exciting device is designed to be driven by an electrical signal having a certain frequency and vibrate the string by applying an excitation signal having a frequency corresponding to the frequency of the electrical signal. The bridge has the first support point and a surface located between the first support point and the second support point and designed to come into contact with the string during vibration of the string.

6 Claims, 36 Drawing Sheets

(56) References Cited

U.S. PATENT DOCUMENTS

| | | | | |
|---|---|---|---|---|
| 2004/0069129 | A1* | 4/2004 | Ludwig | 84/645 |
| 2004/0069131 | A1* | 4/2004 | Ludwig | 84/723 |
| 2004/0074379 | A1* | 4/2004 | Ludwig | 84/645 |
| 2004/0094021 | A1* | 5/2004 | Ludwig | 84/625 |
| 2004/0099127 | A1* | 5/2004 | Ludwig | 84/659 |
| 2004/0099128 | A1* | 5/2004 | Ludwig | 84/662 |
| 2004/0099129 | A1* | 5/2004 | Ludwig | 84/663 |
| 2004/0099131 | A1* | 5/2004 | Ludwig | 84/723 |
| 2004/0118268 | A1* | 6/2004 | Ludwig | 84/645 |
| 2004/0163528 | A1* | 8/2004 | Ludwig | 84/645 |
| 2005/0081703 | A1* | 4/2005 | Hoover | 84/726 |
| 2005/0120870 | A1* | 6/2005 | Ludwig | 84/661 |
| 2005/0126373 | A1* | 6/2005 | Ludwig | 84/661 |
| 2005/0126374 | A1* | 6/2005 | Ludwig | 84/661 |
| 2006/0032364 | A1* | 2/2006 | Ludwig | 84/723 |
| 2006/0090632 | A1* | 5/2006 | Ludwig | 84/645 |
| 2009/0320671 | A1* | 12/2009 | Meeks et al. | 84/735 |
| 2010/0224052 | A1* | 9/2010 | Ludwig | 84/644 |
| 2013/0074681 | A1* | 3/2013 | Langberg | 84/725 |
| 2013/0074682 | A1* | 3/2013 | Langberg | 84/726 |

FOREIGN PATENT DOCUMENTS

| | | | |
|---|---|---|---|
| JP | 3070163 | U | 7/2000 |
| JP | 2001-272972 | A | 10/2001 |
| JP | 2004-45729 | A | 2/2004 |
| JP | 2012-42505 | A | 3/2012 |

* cited by examiner

STRINGED INSTRUMENT

BACKGROUND OF THE INVENTION

1. Field of the Invention

The present invention relates to a stringed instrument. More particularly, it relates to a stringed instrument capable of generating a sound with higher harmonic components or a reverberant sound by an electrical signal.

2. Description of the Related Art

As a musical instrument having a bridge called "jawari" and sympathetic strings for adding higher harmonic components, there have been known a sitar that is an Indian classical musical instrument, and viol family instruments with a device disclosed in U.S. Pat. No. 5,883,318. The sitar or an instrument with the device disclosed in U.S. Pat. No. 5,883,318 has main strings to be directly played and sympathetic strings mainly for producing resonance, wherein one end of the sympathetic string is supported by the jawari bridge.

The jawari bridge is characterized in that its contact surface with the sympathetic strings is a slightly curved convex surface, wherein when the strings vibrate, the strings are brought into contact with the convex surface not only at a first support paint where the string vibration terminates but also at a point located on a vibration side of the first support point, thereby generating a string vibration sound with higher harmonic components. Such a structure is disclosed not only in U.S. Pat. No. 5,883,318 but also in U.S. Pat. No. 3,422,715 and Japanese Unexamined Patent Application Publication No. 2001-279979.

If the sympathetic strings are not supported by the jawari bridge, they will only produce an echo of the sound played with the main strings, but the sympathetic strings supported by the jawari bridge produce a resonant sound with higher harmonic components a little later than the sound played with the main strings.

For example. Japanese Unexamined Patent Application Publication No. 2001-272972 states that an upper surface of a bridge (saddle) for supporting strings is gently curved along the strings and brought into contact with the vibrating strings at two or more positions: a first contact position (first support point) where the vibration terminates and one or more second contact positions located on a vibration side of the first contact position, thereby generating harmonic overtones amply including higher components.

Moreover, a tambura that is also an Indian classical musical instrument is known as an instrument for producing a sustained sound with higher harmonic components. Typically, the tambura has four or five strings and a jawari bridge. A player plucks these strings one by one in an almost steady rhythm, creating a sustained sound in which higher harmonic components are intricately intertwined together.

In the conventional sitar or viol family instruments provided with the device disclosed in U.S. Pat. No. 5,883,318, however, the resonant sound with higher harmonic components can be generated only by playing the main strings of the instrument. The resonant sound with higher harmonic components cannot be adequately generated by a sound coming from the outside of the instrument.

That is, although the stringed instruments can produce a sound with higher harmonic components in response to the sound from the main strings, this effect cannot be obtained without the playing skills. Therefore, there are only a small number of players who can bring about and enjoy the effect. People who do not have the skills of playing these stringed instruments cannot generate and enjoy a resonant sound with higher harmonic components. In addition, when the sound from the main strings is small, it is impossible to adequately generate a resonant sound with higher harmonic components.

Moreover, since many strings are exposed to the outside of the instrument, touching a pointed end of the string may cause injury or when the string is broken, the string may spring to cause injury. Furthermore, since many strings are exposed to the outside of the instrument, it is difficult to maintain the body of the instrument.

On the other hand, the tambura needs a player who plucks the strings one by one in an almost steady rhythm. If a sound unique to the tambura, i.e., a sustained sound in which higher harmonic components are intricately intertwined together can be created without such a player, it would be welcomed.

Meanwhile, Japanese Unexamined Patent Application Publication No. H04-060594 discloses a stringed instrument comprising a string, an electromagnetic exciter and a bridge, wherein the electromagnetic exciter is driven by a command signal from a controller to vibrate the string.

In the stringed instrument of Japanese Unexamined Patent Application Publication No. H04-060594, after a key is pressed by a finger and the string is struck and vibrated by a hammer which moves in response to the key press, the vibration state of the string is controlled by an induced magnetic field from the electromagnetic exciter to vary the timbre of the string or the like. Japanese Unexamined Patent Application Publication No. H04-060594 also discloses that the excitation frequency of the electromagnetic exciter can be controlled by a command from the controller; the vibration state of the string can be varied by applying the induced magnetic field from the electromagnetic exciter to the vibrating string; the electromagnetic exciter can be moved to and set at a position corresponding to a loop of a high-frequency string vibration which generates a specific harmonic component as the string is in a constant vibration state, and the induced magnetic field can be applied thereto so as to emphasize or weaken the harmonic component; and the induced magnetic field may have an induction frequency in phase with the string vibration to emphasize the string vibration, while the induced magnetic field may be opposite in phase to the string vibration to weaken the string vibration.

However, the stringed instrument, of Japanese Unexamined Patent Application Publication No. H04-060594 is basically such that after a key is pressed by a finger and the string is struck and vibrated by a hammer which moves in response to the key press, the vibration state of the string is controlled by an induced magnetic field from the electromagnetic exciter to vary the timbre of the string or the like. Therefore, since the skills to play the stringed instrument are required also in the case of Japanese Unexamined Patent Application Publication No. H04-060594, the people who do not have the playing skills cannot enjoy the sound effect disclosed in Japanese Unexamined Patent Application Publication No, H04-060594. In this respect, the technology disclosed in Japanese Unexamined Patent Application Publication No. H04-060594 is not different from the technologies disclosed in U.S. Pat. No. 5,883,318, U.S. Pat. No. 3,422,715 and Japanese Unexamined Patent Application Publication No. 2001-272972.

SUMMARY OF THE INVENTION

It is an object of the present invention to provide a stringed instrument with which people who do not have the playing skills can enjoy a sound with higher harmonic components, a reverberant sound, a sustained sound or the like.

It is another object of the present invention to provide a stringed instrument with which a sound with higher harmonic components, a reverberant sound or a sustained sound can be generated readily and adequately.

It is still another object of the present invention to provide a safe B) stringed instrument.

In order to attain at least one of the above-described objects, a stringed instrument according to the present invention comprises a body, a string, a string exciting device and a bridge. The body supports the string, the string exciting device and the bridge, the string has a scale length determined by a distance between a first support point and a second support point, and the string exciting device is designed to be driven by an electrical signal to vibrate the string in response to the electrical signal. In the above configuration, the stringed instrument according to the present invention satisfies any of the following matters specifying the invention (a) to (d).

(a) The bridge has the first support point and a surface located between the first support point and the second support point and designed to come into contact with the string during vibration of the string.

(b) The bridge has the first support point and a surface located between the first support point and the second support point and designed to come into contact with the string during vibration of the string, the body has an internal space, and the string, the string exciting device and the bridge are disposed in the internal space of the body.

(c) The bridge has the first support point and a surface located between the first support point and the second support point and designed to come into contact with the string during vibration of the string, and the string and the bridge are disposed on an exterior surface of the body.

(d) The bridge has the first support point but is configured not to come into contact with the string during vibration of the string at any point between the first support point and the second support point, the body has an internal space, and the string, the string exciting device and the bridge are disposed in the internal space of the body.

In the stringed instrument according to the present invention, regardless of which one of the matters specifying the invention (a) to (d) is satisfied, the string exciting device is driven by an electrical signal to vibrate the string in response to the electrical signal. Accordingly even the people who do not have the playing skills can enjoy sounds generated from the stringed instrument, according to the present invention by supplying a voice or various sounds from any playable instrument or the like to the string exciting device as an electrical audio signal. This effect cannot be anticipated from the technology of Japanese Unexamined Patent Application Publication No. H04-060594, which requires the playing skills. In addition, a sound with higher harmonic components, a reverberant sound or a sustained sound can be generated readily and adequately.

When satisfying any of the matters specifying the invention (a) to (c), the bridge has the first support point and as surface located between the first support point and the second support point and designed to come into contact with the string during vibration of the string. Therefore, if the excitation frequency from the string exciting device is identical or close to the natural resonance frequency of the string or its harmonic frequency, the string resonates and vibrates at the excitation frequency from the string exciting device and the vibrating string comes into contact with the surface of the bridge in an intricate manner to generate a resonant sound with various higher harmonic components added to the string vibration. Accordingly, even the people who do not have the playing skills can enjoy a resonant sound with higher harmonic components, as with the sitar that is an Indian to classical musical instrument. It should be noted that the vibration frequency of the string varies depending on the scale length, tension, linear density and so on.

When satisfying the matter specifying the invention (b), since the string, the string exciting device and the bridge are disposed in the internal space of the body, the risk of injury from touching a pointed end of the string or being hit by a broken string can be eliminated. There is also an advantage of facilitating the maintenance of the body.

When satisfying the matter specifying the invention (d), on the other hand, since the bridge has the first support point but is configured not to come into contact with the string during vibration of the string at any point between the first support point and the second support point, people can enjoy a reverberant sound due to a string vibration sound generated from the string resonating at a variety of excitation frequencies applied from the string exciting device.

Also in this case, since the string, the string exciting device and the bridge are disposed in the internal space of the body, the risk of injury from touching a pointed end of the string or being hit by a broken string can be eliminated. There is also an advantage of facilitating the maintenance of the body.

In the stringed instrument, according to the present invention, furthermore, the string exciting device may include an exciter and a converter. The exciter is provided for the string to vibrate the string. The converter is provided for the string to convert its vibration to an electrical signal.

In stringed instruments of this type, when the string starts to vibrate slightly, its vibration is detected and converted to an electrical signal by the converter. The electrical signal is fed back to the exciter of the vibrating string through an amplifier circuit or the like. The exciter further vibrates the vibrating string in response to the feedback signal. Thus, there is formed a positive feedback oscillator circuit.

With the above oscillator circuit, even when the string is not yet sounded, a noise generated in the positive feedback loop or the like, acts as a trigger signal to cause positive feedback, whereby the string starts to vibrate at the natural resonance frequency or its harmonic frequency. Once the string starts to vibrate, the string vibration sound grows louder until the vibration reaches a certain amplitude. After reaching a certain amplitude, the string vibration is maintained at such a stable state. When the stringed instrument stops to function, the string vibration weakens and the sound stops.

When the bridge has a structure specified in the matters specifying the invention (a) to (c), i.e., when the bridge has the first support point and a surface located between the first support point and the second support point and designed to come into contact with the string during vibration of the string, there is generated a sustained sound with higher harmonic components added to a vibration sound based on the oscillation frequency of the oscillator circuit. When the bridge has a structure specified in the matter specifying the invention (d), i.e., when the bridge has the first support point but is configured not to come into contact with the string during vibration of the string at any point between the first support point and the second support point, there is generated a sustained sound due to string vibration. It is also possible to combine two or more stringed instruments satisfying any of the matters specifying the invention (a) to (d).

In the present invention, the string exciting device may comprise an electromagnetic coil, a piezoelectric vibrator, a magnetostrictive vibrator, a giant magnetostrictive vibrator, a voice coil exciter, a speaker or the like. They are interchangeable unless it is contrary to the nature thereof. Regarding various types of embodiments described below, therefore, one embodiment illustrated herein should be construed as suggesting the use of other types of exciters not illustrated herein. On the other hand, the converter preferably comprises a non-contact vibration detection sensor. One preferred embodiment is an electromagnetic coil.

According to the present invention, as described above, the following effects can be obtained.

(a) It is possible to provide a stringed instrument with which even the people who do not have the playing skills can enjoy a sound with higher harmonic components, a reverberant sound, a sustained sound or the like.

(b) it is possible to provide a stringed instrument with which a sound with higher harmonic components, a reverberant sound or a sustained sound can be generated readily and adequately.

(c) It is possible to provide a safe stringed instrument.

The present invention will be more fully understood from the detailed description given hereinbelow and the accompanying drawings which are given by way of illustration only, and thus not to be considered as limiting the present invention.

DESCRIPTION OF THE PREFERRED EMBODIMENTS

Figure 1:
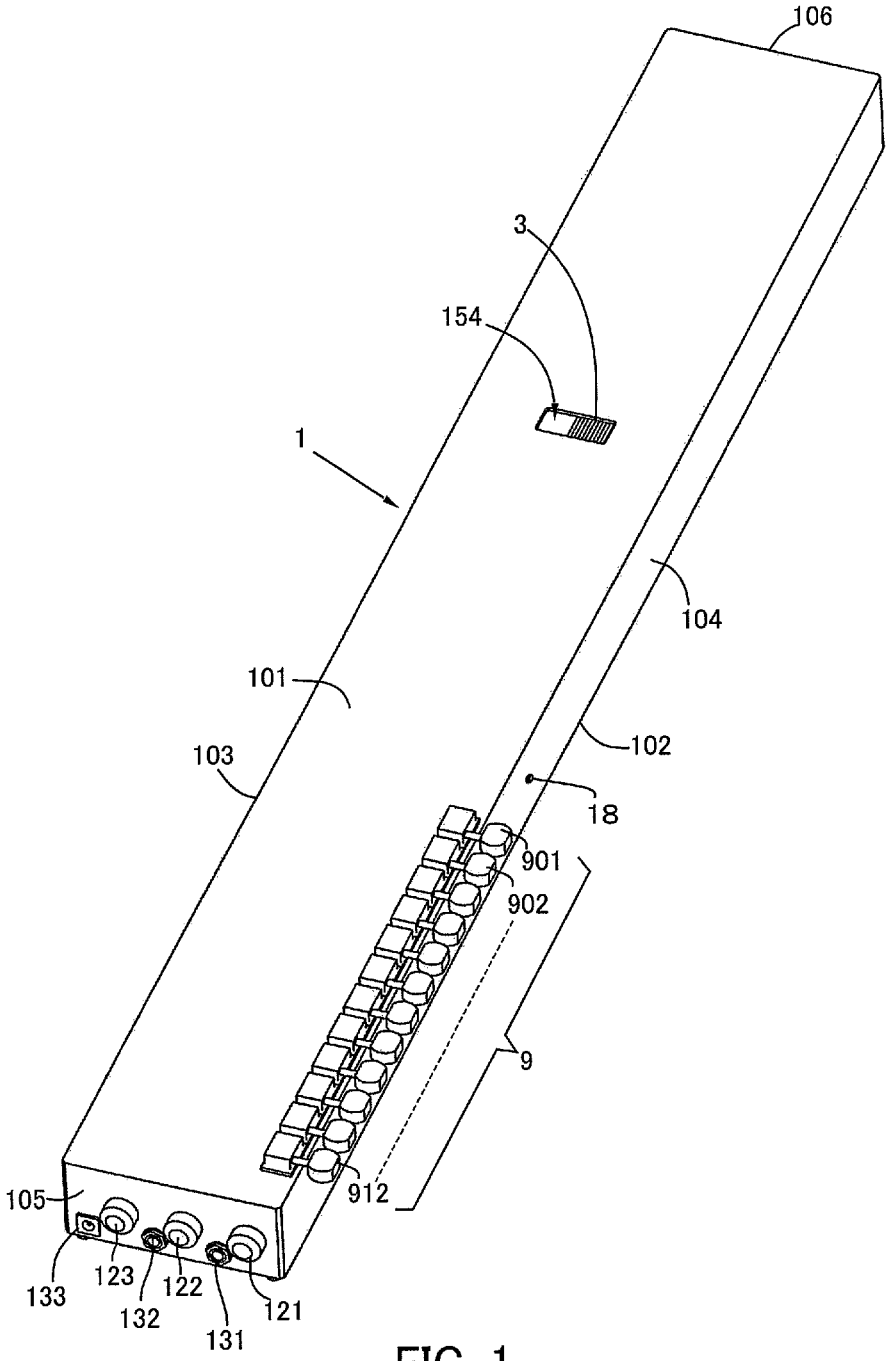
FIG. 1 is an external perspective view showing one embodiment of the stringed instrument according to the present invention.

Through FIGS. 1 to 41, corresponding parts are denoted by the same reference symbols, and duplicate explanations are omitted. Among FIGS. 1 to 41, FIGS. 1 to 30 relate to a stringed instrument with a jawari bridge (hereinafter referred to as "first type"), FIGS. 31 to 33 relate to a stringed instrument without a jawari bridge (hereinafter referred to as "second type"), and FIGS. 34 to 36 relate to a stringed instrument with an oscillator circuit (hereinafter referred to as "third type").

1. First Type

Referring first to FIGS. 1 to 5 relating to the first type, the illustrated stringed instrument comprises a body 1, a plurality of strings 3, a string exciting device 5 and a bridge 7. The body 1 has an internal space 100 and a top panel 101, a bottom panel 102 and four side panels 103 to 106 defining the internal space 100. However, it is not necessarily required to have the internal space 100 and provide all of the bottom panel 102 and the four side panels 103 to 106 defining the internal space 100.

The panels 101 to 106 defining the internal space 100 are typically wooden boards. However, it is also possible that they comprise wholly or partially a metallic material, a non-metallic material or a composite material thereof. The non-metallic material may be a carbon graphite, a synthetic fiber such as glass fiber, a synthetic resin or a composite material thereof. It is also possible to use a laminate of such materials or the like.

In this embodiment, the body 1 is in the form of hexahedron but should not be construed as limited to this configuration. It may be in the form of a plate not having the internal space 100 or in other forms having a curved surface or the like. In the body 1, furthermore, the thickness is reduced at an appropriate part to improve the sound effects but increased at other parts to increase the mechanical strength or the like. However, if vibration of the strings 3 is to be amplified by an electrical/electronic circuit or the like and then transmitted to the outside without any dependency on a sound generated from the stringed instrument itself, a high priority may be given to the mechanical strength by increasing the thickness of the whole body 1 without leaving any thin part. This structure is also effective in making the body 1 less susceptible to a sound pressure from the outside.

Among the panels 101 to 106, the top panel 101 has a small window 154. At one end of the top panel 101, there are arranged tuning pegs 9. The tuning pegs 9 penetrate the top panel 101 with knobs of the pegs 901 to 912 located outside the top panel 101. In this embodiment, since the top panel 101 has the small window 154, the strings can be tuned with the tuning pegs 901 to 912 by plucking each string with a finger through the small window 154. The pegs 901 to 912 are provided according to the number of the strings 3. Therefore, the number of the pegs 901 to 912 varies with the number of the strings 3. In this embodiment, since twelve strings 301 to 312 are provided, twelve pegs 901 to 912 are provided accordingly.

On the exterior surface of the bottom panel 102 opposed to the top panel 101, three legs 151 to 153 are disposed in a standing position at three vertices of a triangle. These three legs 151 to 153 support the body 1. Even if a surface on which the stringed instrument is to be placed is not flat, all the legs 151 to 153 can be brought into contact with the surface to support the body 1.

Among the four side panels 103 to 106, the side panel 105 has a potentiometer 121 as a power switch and an input volume control, a potentiometer 122 as an original volume control, a potentiometer 123 as an output volume control, an input jack 131, an output jack 132 and a power jack 133. Instead of supplying power through the power jack 133, it is also possible to provide a battery or a rechargeable battery that can be charged through the power jack 133.

The strings 3, the stung exciting device 5 and the bridge 7 are disposed in the internal space 100 of the body 1. Referring first to the strings 3, the twelve strings 301 to 312 are arranged at intervals in parallel to each other. Accordingly, they can be tuned not only to individual pitches of twelve-tone equal temperament but also to a specific scale as long as the strings have the same pitches as the characteristic pitches in the scale. They can also be tuned to any tuning consisting of micro-tones. Of course, it is also possible to increase or decrease the number of the strings 301 to 312.

In this embodiment, the strings 3 are magnetic metallic wires. However, they may be non-magnetic wires if needed. With their first ends fixed by a tail piece 142 disposed on the interior surface of the top panel 101 in the vicinity of the side panel 106, the strings 3 (301 to 312) are directed along the interior surface of the top panel 101 toward the side panel 105 opposed to the side panel 106. The tail piece 142 is fixed by screws 143 or the like onto a support 141 formed on the interior surface of the top panel 101 (see FIG. 4). Moreover, the strings 3 (301 to 312) are wound about pins 161 to 172 standing on the interior surface of the top panel 101 to have their second ends wound onto winding shafts 921 to 932 of the pegs 901 to 912 penetrating the top panel 101 from the exterior surface to the interior surface. In this embodiment, different scale lengths are set by changing the positions of the pins 161 to 172 with respect to the strings 301 to 312, thereby covering a wide range. The range can be controlled not only by the scale length but also by the tension, the linear density and so on.

Figure 4:
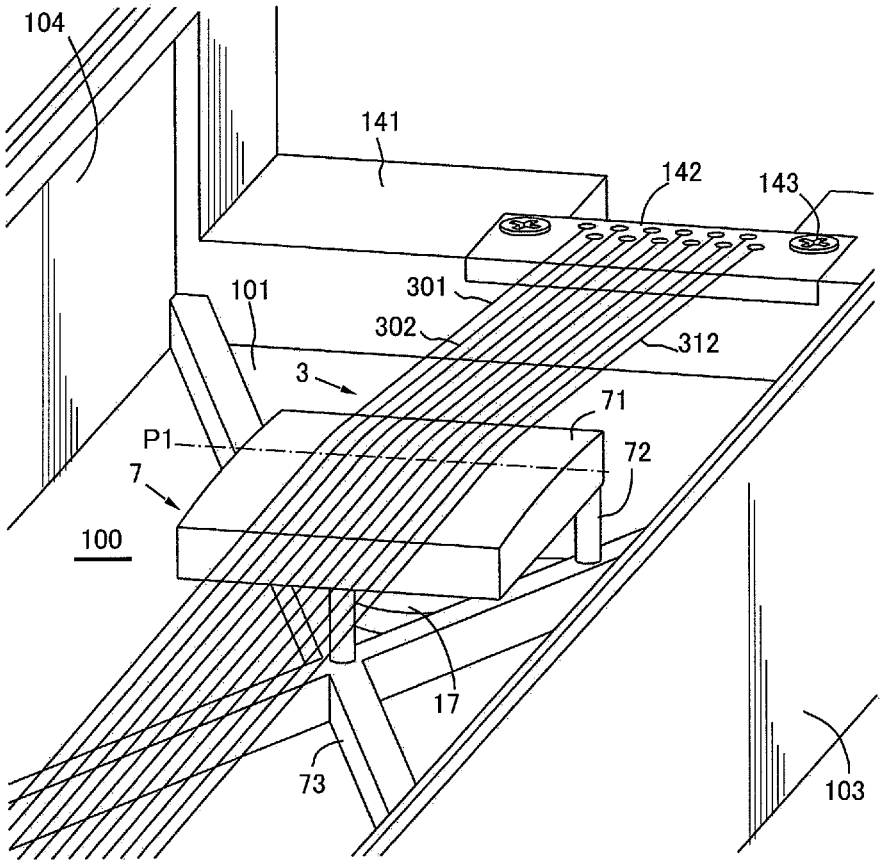
FIG. 4 is an enlarged view showing a bridge in the state of FIG. 3.
Figure 5:
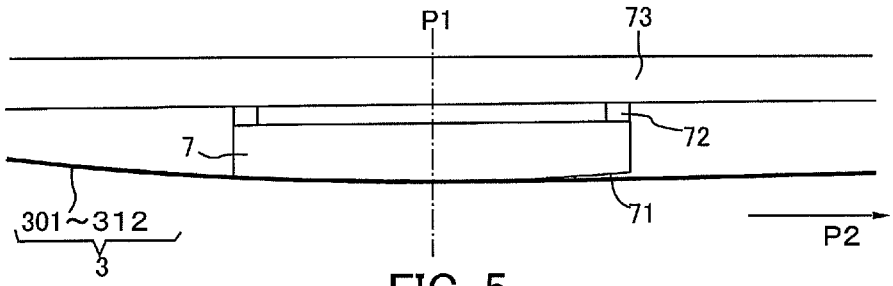
FIG. 5 is a drawing showing a relationship between the bridge and strings in FIG. 4.

In the internal space 100 of the body 1, furthermore, the bridge 7 and the string exciting device 5 are disposed. Details of the bridge 7 are shown in FIGS. 4 and 5. Such a bridge is referred to as "jawari bridge" in this specification. In the jawari bridge 7, as shown in the drawings, a surface 71 intended to come into contact with the strings 3 is a slightly curved convex surface. Since the strings 3 are supported by the jawari bridge 7, they can generate a sound with higher harmonic components.

Figure 3:
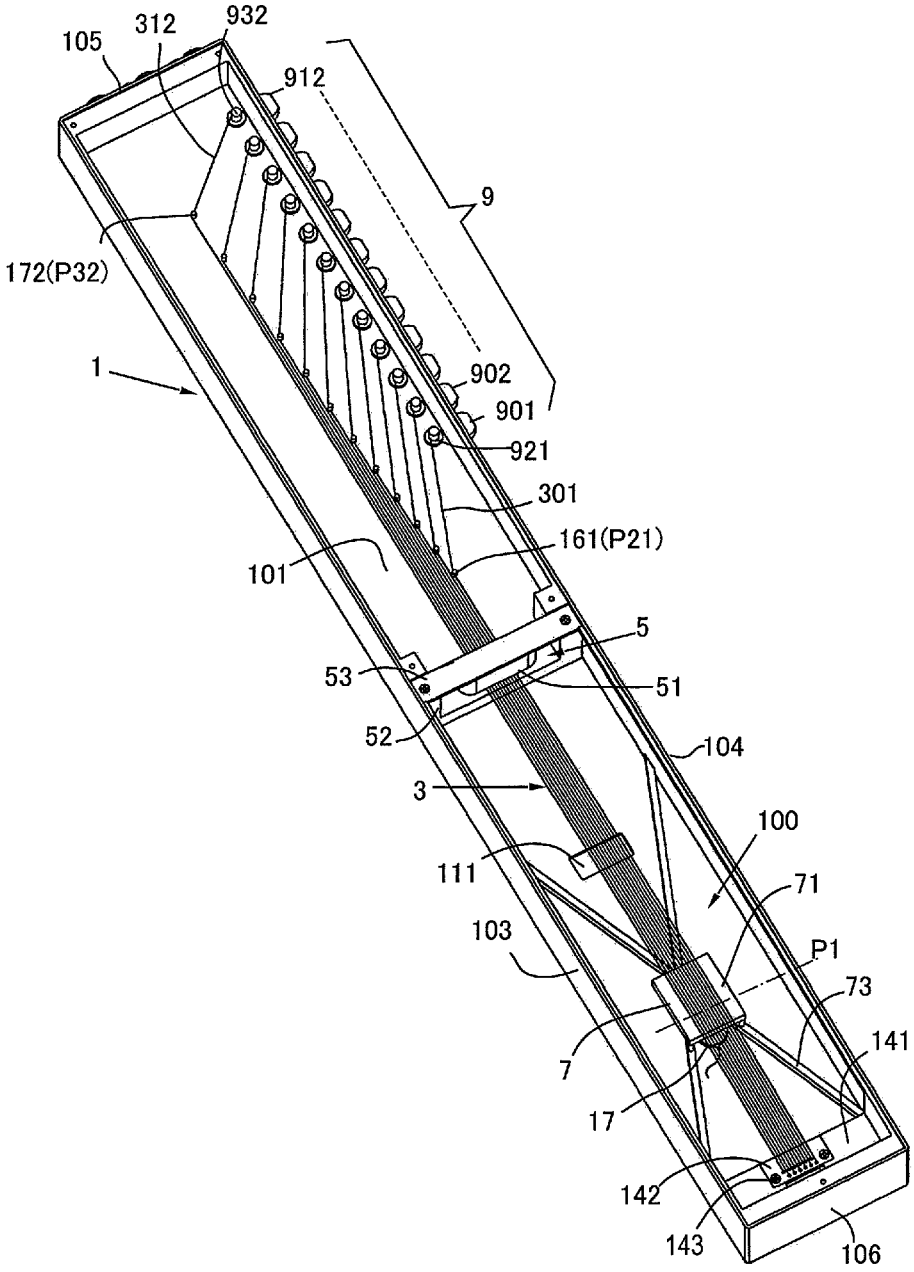
FIG. 3 is a perspective view in which the stringed instrument of FIGS. 1 and 2 is shown with its bottom panel removed.

In this embodiment, the strings 301 to 312 have different, scale lengths, wherein the contact point with the convex surface 71 is a first support point P1, while the contact points with the pins 161 to 172 are second support points P21 to P32 (see FIGS. 3 to 5). The first support point P1 is determined by the angle of inclination of the strings 301 to 312 with respect to the surface 71. Therefore, the first support points P1 of the strings 301 to 312 do not necessarily coincide with each other. Hereinbelow, however, they will be described as coinciding with each other for the sake of simplifying the explanation. It should be noted that the angle of inclination of the strings 301 to 312 can be adjusted by controlling a height where the string is supported at the second support points P21 to P32.

The second support points P21 to P32 do not coincide with each other. Since the surface 71 of the jawari bridge 7 is a convex surface, a part of the surface 71 located between the first support point. P1 and the second support points P21 to P32 is opposed to the strings 3 with a small distance and comes into contact with the strings 3 during vibration of the strings 3.

Figure 6:
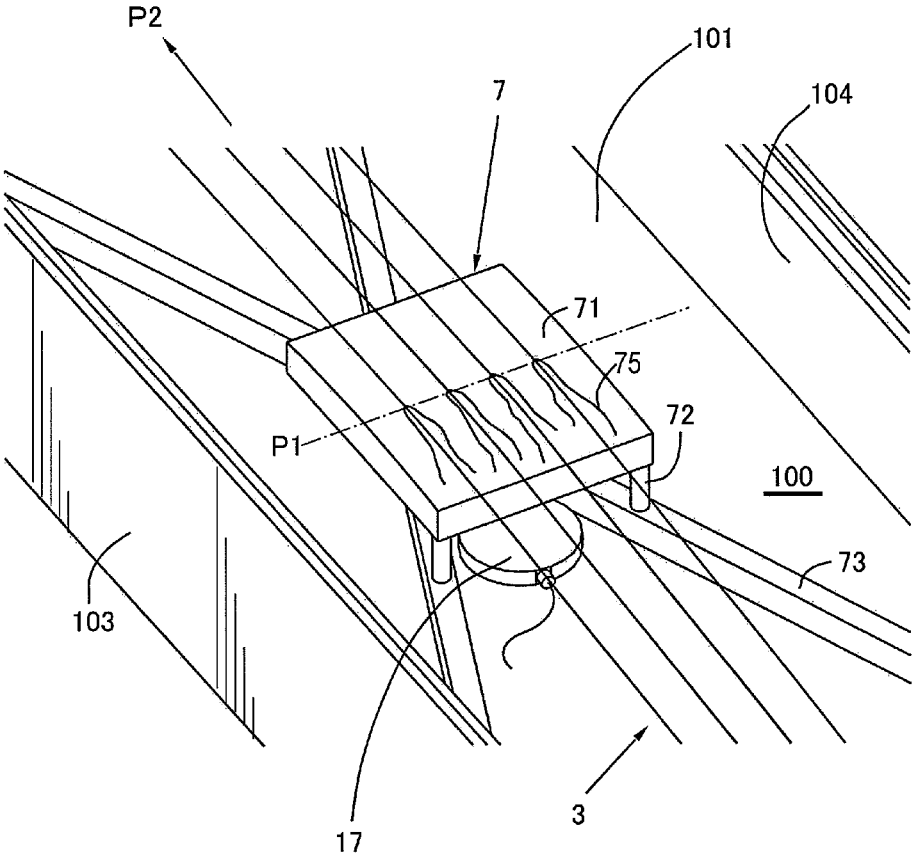
FIG. 6 is a perspective view showing another embodiment of the stringed instrument according to the present invention with its bottom panel removed.
Figure 7:
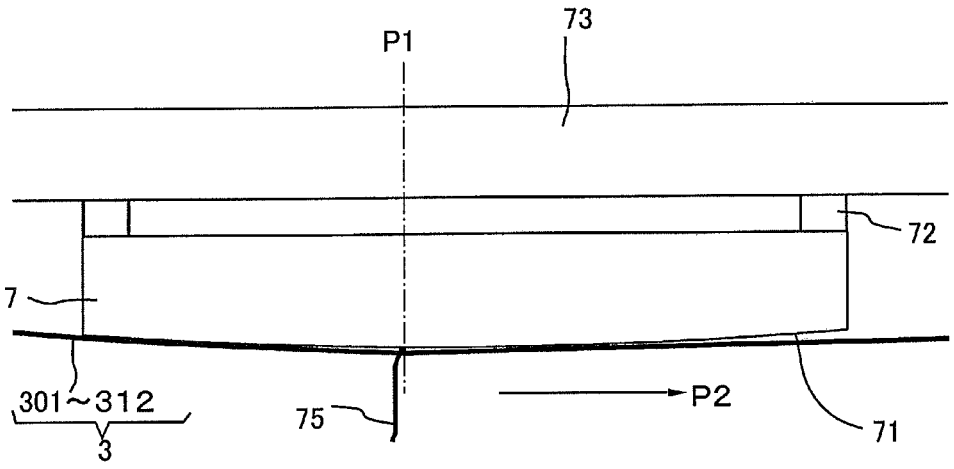
FIG. 7 is an enlarged view showing a bridge in the stringed instrument of FIG. 6.

Since the contact of the strings 3 and the resulting vibration characteristics of the strings 3 are greatly influenced by the small distance formed between the strings 3 and the surface between the first support point P1 and the second support points P21 to P32, it is highly advantageous to provide a means for adjusting the small distance to adjust the vibration characteristics of the strings 3. One example of such an adjusting means is shown in FIGS. 6 and 7. In this embodiment, adjusters 75 comprising a thin linear material such as an organic yarn, an inorganic yarn or a composite yarn thereof are put between the surface 71 and the strings 301 to 312 so as to adjust the small distance at and forward of the first support point. P1. The individual strings 301 to 312 have their own adjuster 75 to be moved along the longitudinal direction to adjust the small distance. In general, the first support point P1 coincides with the position of the adjuster 75.

Figure 8:
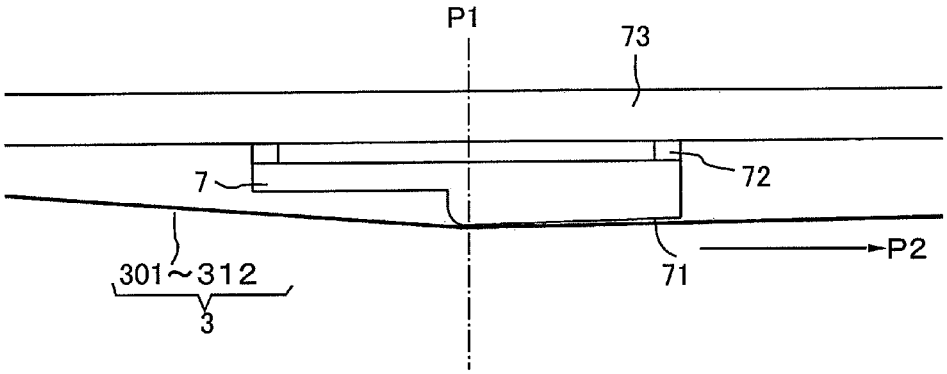
FIG. 8 is a drawing showing another bridge used in the stringed instrument, according to the present invention.

The surface 71 need not be a convex surface. For example, it may be a simple inclined surface, as shown in FIG. 8. The first support point. P1 can be formed by bringing the strings 3 into contact with the end of the inclined surface.

The bridge 7 is supported by a plurality of supports 72 standing on a bracing 73 disposed on the interior surface of the top panel 101. A part of the top panel 101 where the bridge 7 is to be mounted is preferably made thin from the viewpoint of improving the sound effects. The bracing 73 serves as a means for compensating for a decrease in mechanical strength due to the reduction in thickness. On the other hand, the area where the pins 161 to 172 are to be disposed in a standing position is made thick so as to increase the mounting strength of the pins 161 to 172. In this embodiment, a thickness changing part is provided roughly in the center of the top panel 101 in the longitudinal direction. As already described above, when vibration of the strings 3 should be amplified by an electrical/electronic circuit or the like and then transmitted to the outside or when the body 1 should be made less susceptible to a sound pressure from the outside, the whole body 1 can be made thick without leaving any thin part.

The string exciting device 5 is designed to be driven by an electrical signal supplied from the outside to vibrate the strings 3 in response to the electrical signal and has an exciter 51. As shown in FIG. 3, the exciter 51 is mounted on the interior surface of the top panel 101 of the body 1. In this embodiment, the exciter 51 is a magnetic driver having an electromagnetic coil (electromagnetic driver) and disposed in a position capable of directly applying a magnetic force to the strings (magnetic metallic wires) 3 so as to vibrate the strings 3 by the action of a magnetic force generated in response to an input signal. More specifically, a support 52 is disposed on the interior surface of the top panel 101 at the midpoint of the strings 3 from the jawari bridge 7 to the pins 161 to 172, and a mounting plate 53 for supporting the exciter 51 including an electromagnetic coil is fixed on the support 52, for example, by screws. The electromagnetic coil of the exciter 51 has a well-known structure: a coil is wound around a core to emit a magnetic force from an end face of the core. The exciter 51 may be disposed obliquely with respect to the direction of the strings 3 so as to keep constant the patio of the excitation point to the scale length.

The exciter 51 of the string exciting device 5 is located close to the strings 3 to such an extent that it never comes into contact with the vibrating strings 3. This is intended to apply the magnetic force to the strings 3 most efficiently if the magnetic force is applied to a magnetic material other than the strings 3, the original sound may be generated therefrom. By applying the magnetic force to the strings 3 efficiently and directly, the strings 3 can be vibrated without producing the input original sound from the string exciting device 5. It can also reduce the power consumption.

On the interior surface of the top panel 101 of the body 1, there is disposed a piezoelectric pickup 17 having a piezoelectric element. The piezoelectric pickup 17 can pick up vibration of the top panel 101 of the body 1. In this embodiment, the piezoelectric pickup 17 is disposed beneath the jawari bridge 7 but is not limited to the illustrated position as long as it can pick up vibration of the top panel 101 of the body 1. For example, it may be disposed on or within the bridge 7.

At its side panel 104, the body 1 has a built-in microphone 18 directed toward the outside of the body 1. The built-in microphone 18 (see FIGS. 1 and 2) preferably a small unidirectional microphone.

As described above, the stringed instrument shown in FIGS. 1 to 5 includes the body 1, the strings 3 and the bridge 7, and not only the strings 3 but also the bridge 7 supporting the strings 3 at the first support point P1 is supported by the body 1. Therefore, the stringed instrument generates a sound having a vibration frequency that depends on the scale length of the string 3 determined by the first support point. P1 and the second support point P21 to P32, the tension, the linear density, etc.

The stringed instrument according to the present invention further includes the string exciting device 5, and the exciter 51 of the string exciting device 5 is driven by an electrical signal to vibrate the strings 3 in response to the electrical signal. Therefore, even the people who do not have the playing skills can enjoy sounds generated from the stringed instrument according to the present invention by supplying a voice or various sounds from any playable instrument or the like to the string exciting device 5 as an electrical audio signal. As clearly understood from the foregoing explanation and drawings, the strings 3 are vibrated only by the exciter 51.

Since the bridge 7 has the first support point P1 and the surface 71 located between the first support point P1 and the second support points P21 to P32 and designed to come into contact with the strings 3 during vibration of the strings 3, when the string 3 resonates and vibrates in response to the excitation signal from the exciter 51 of the string exciting device 5, the string 3 comes into contact with the surface 71 of the bridge 7 in an intricate manner to generate a resonant sound with higher harmonic components added to the string vibration. Accordingly, even the people who do not have the playing skills can enjoy a resonant sound with higher harmonic components, as with the sitar that is an Indian classical musical instrument. In addition, since the strings 3 are vibrated by the string exciting device 5, the resonant sound with higher harmonic components can be generated readily and adequately.

Figure 2:
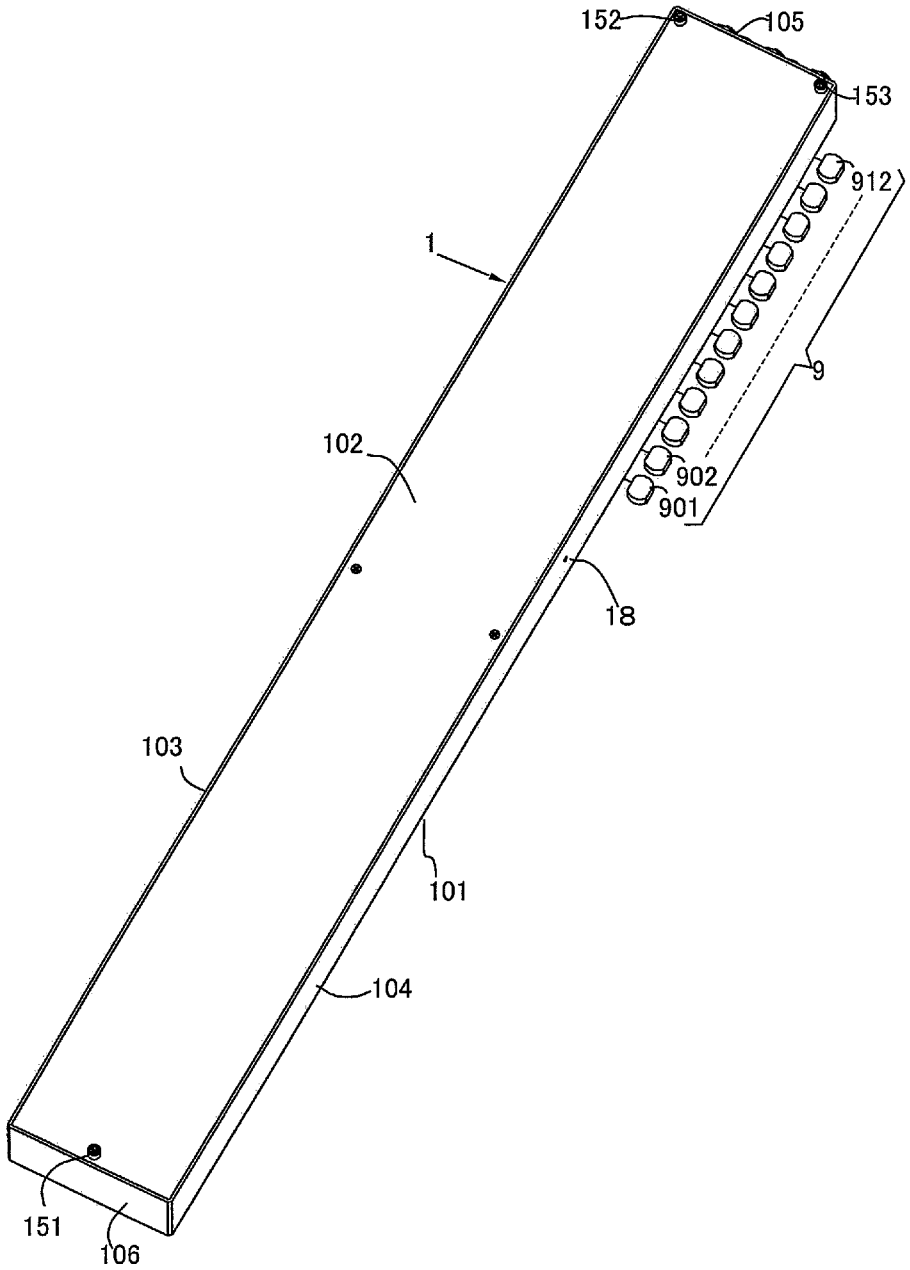
FIG. 2 is a perspective view in which the stringed instrument of FIG. 1 is seen from the bottom side.

In the embodiment shown in FIGS. 1 to 3, moreover, since the strings 3, the string exciting device 5 and the bridge 7 are disposed in the internal space 100 of the body 1, the risk of injury from touching a pointed end of the string 3 or being hit by a broken string 3 can be eliminated. There is also an advantage of facilitating the maintenance of the body 1. In FIGS. 5 to 8, the arrow P2 indicates the area where the second support points P21 to P82 are arranged.

Figure 9:
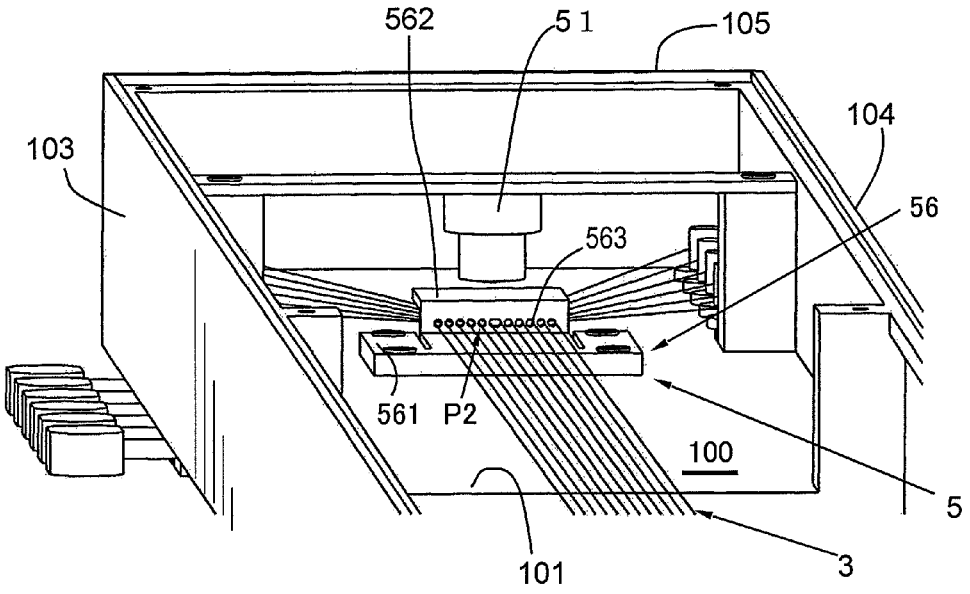
FIG. 9 is a drawing showing a string exciting device used in another embodiment of the stringed instrument according to the present invention.

In another embodiment shown in FIG. 9, a vibration transmitting part 562 of a support 56 disposed on the interior surface of the top panel 101 is vibrated by an exciter 51 including an electromagnetic coil to indirectly vibrate the strings 301 to 312 passing through through-holes 563 formed in a rising part of the vibration transmitting part 562. The support 56 has an anchor part 561 fixed to the interior surface of the top panel 101, and the vibration transmitting part 562 projects from one end of the anchor part 561. In the support 56, at least a part of the vibration transmitting part 562 opposed to the exciter 51 including an electromagnetic coil comprises, partially or entirely, a magnetic material. It is also possible that the whole support 56 comprises a magnetic material.

Figure 10:
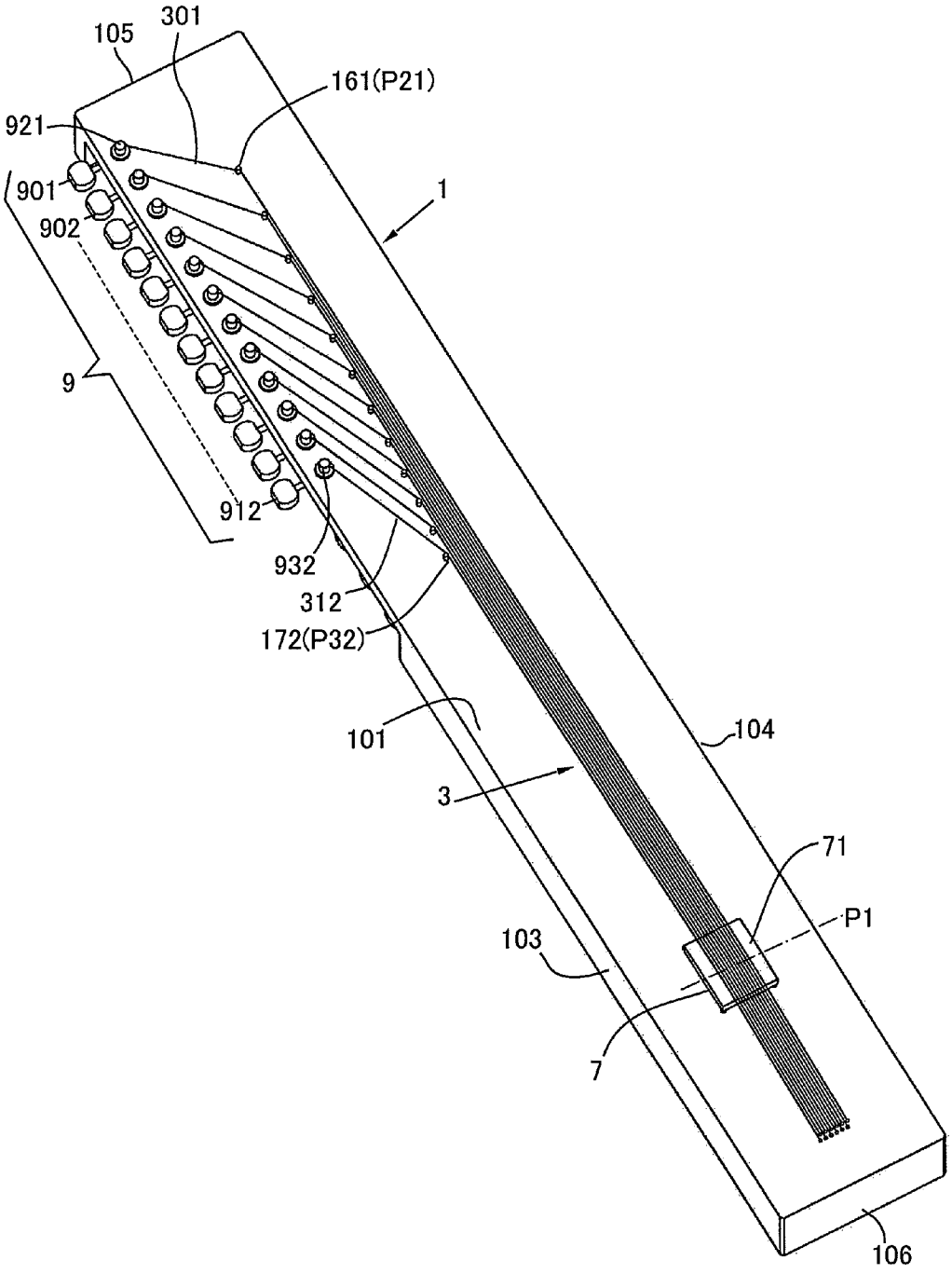
FIG. 10 is an external perspective view showing another embodiment of the stringed instrument according to the present invention.
Figure 11:
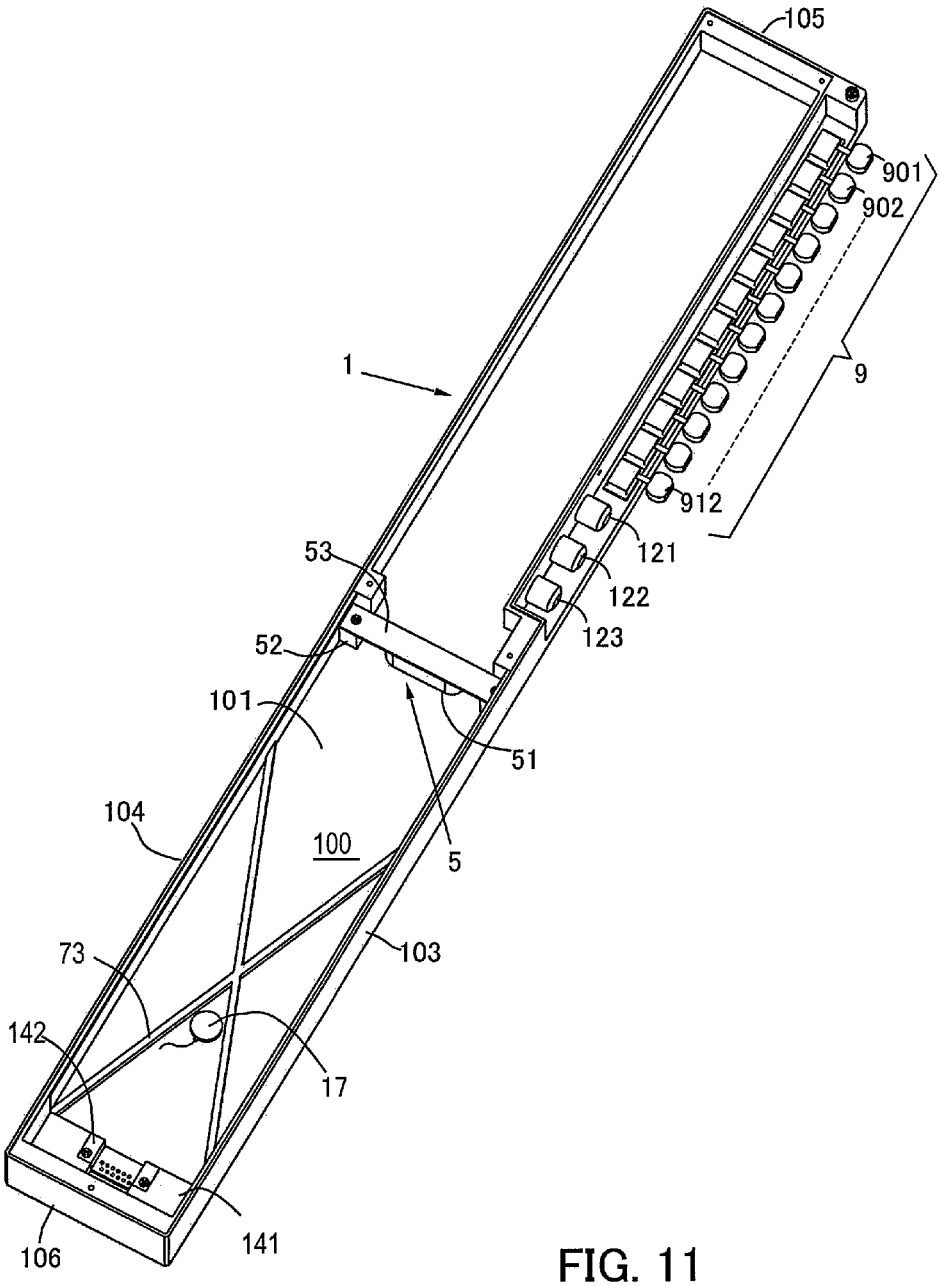
FIG. 11 is a perspective view in which the stringed instrument of FIG. 10 is seen from the bottom side with its bottom panel removed.
Figure 12:
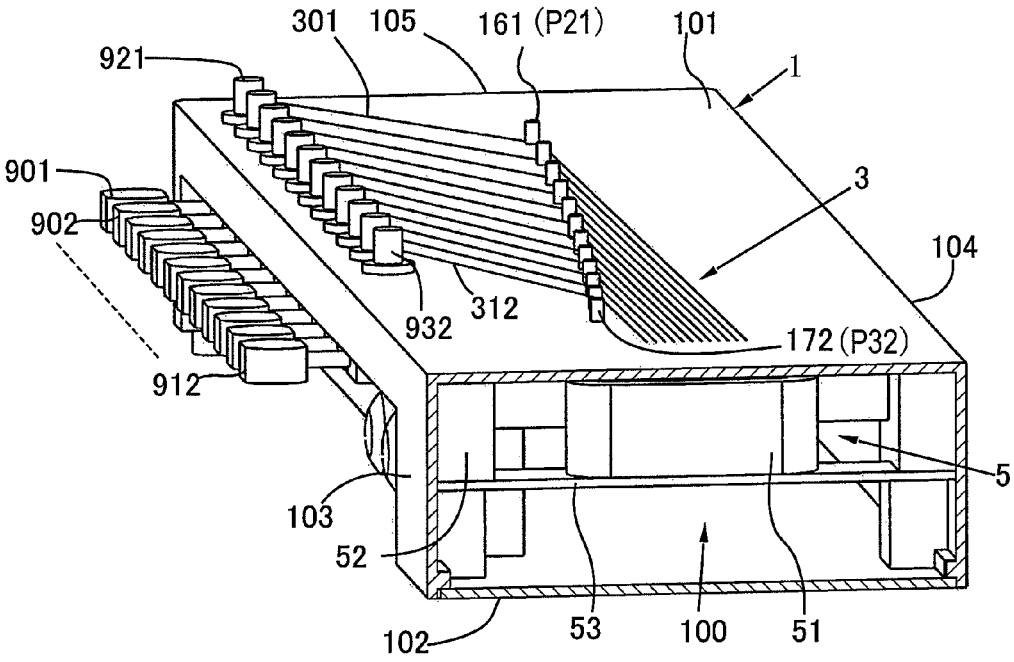
FIG. 12 is a perspective view in which the stringed instrument of FIGS. 10 and 11 is cut at an appropriate position in its longitudinal direction.

Referring next to FIGS. 10 to 12, the strings 3 and the bridge 7 are disposed on the exterior surface of the top panel 101 of the body 1. The string exciting device 5 is disposed in the internal space 100 of the body 1. The bridge 7 may be the jawari bridge shown in FIGS. 4 and 5 or the jawari bridge shown in FIGS. 6 to 8. While the strings 3 and the bridge 7 are disposed on the exterior surface of the body 1, the electromagnetic coil of the exciter 51 of the string exciting device 5 is disposed in the internal space 100 of the body 1. Therefore, the magnetic force from the electromagnetic coil of the exciter 51 acts on the strings 3 through the top panel 101. As shown in FIGS. 11 and 12, the string exciting device 5 has a support 52 in contact with the interior surface of the top panel 101, and a mounting plate 53 for supporting the exciter 51 is fixed on the support 52, for example, by screws.

Also in the embodiment shown in FIGS. 10 to 12, since the bridge 7 is a jawari bridge 7 whose surface 71 intended to come into contact with the strings 3 is a convex surface, people can enjoy a resonant sound with higher harmonic components, as with the sitar.

Figure 13:
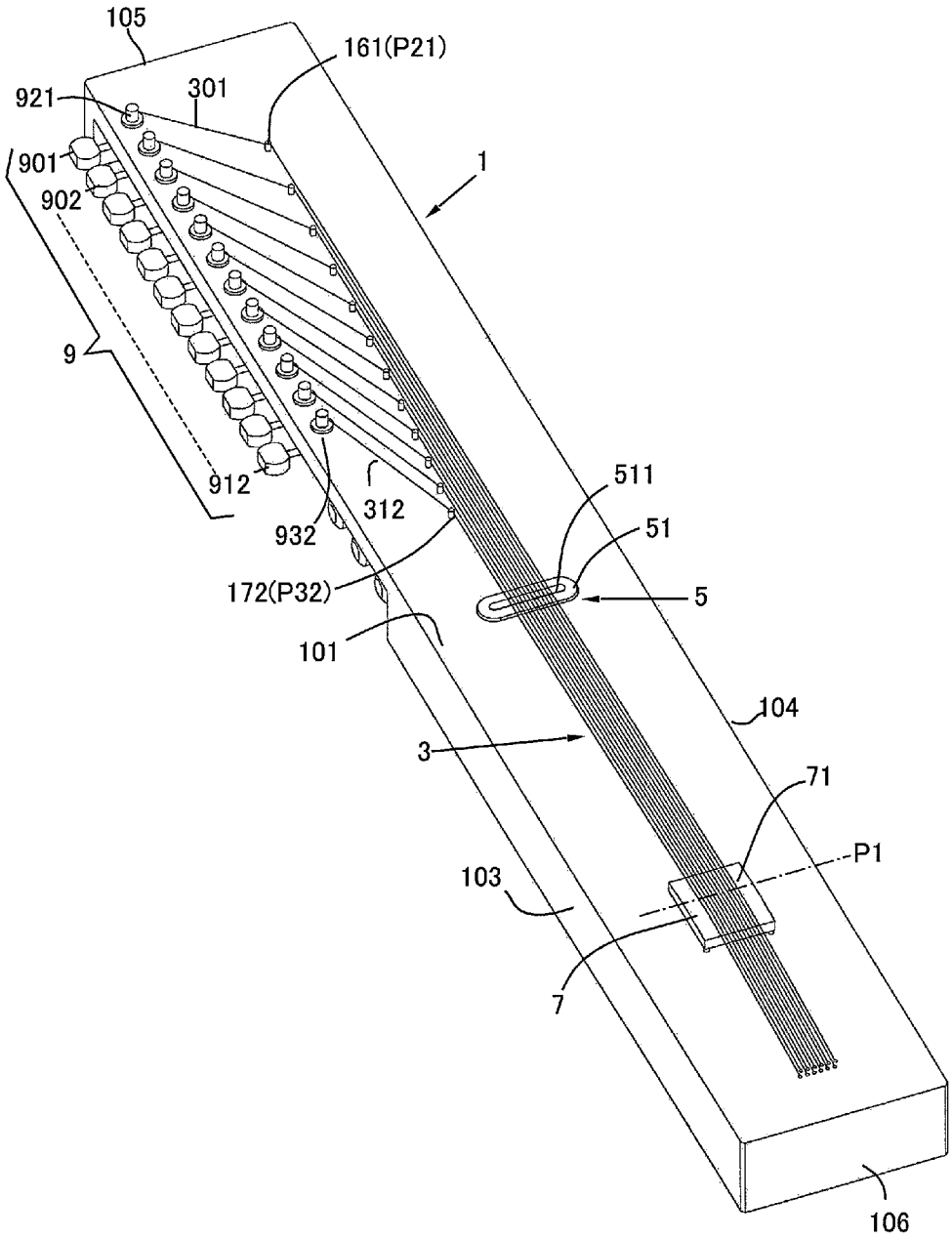
FIG. 13 is an external perspective view showing still another embodiment of the stringed instrument according to the present invention.
Figure 14:
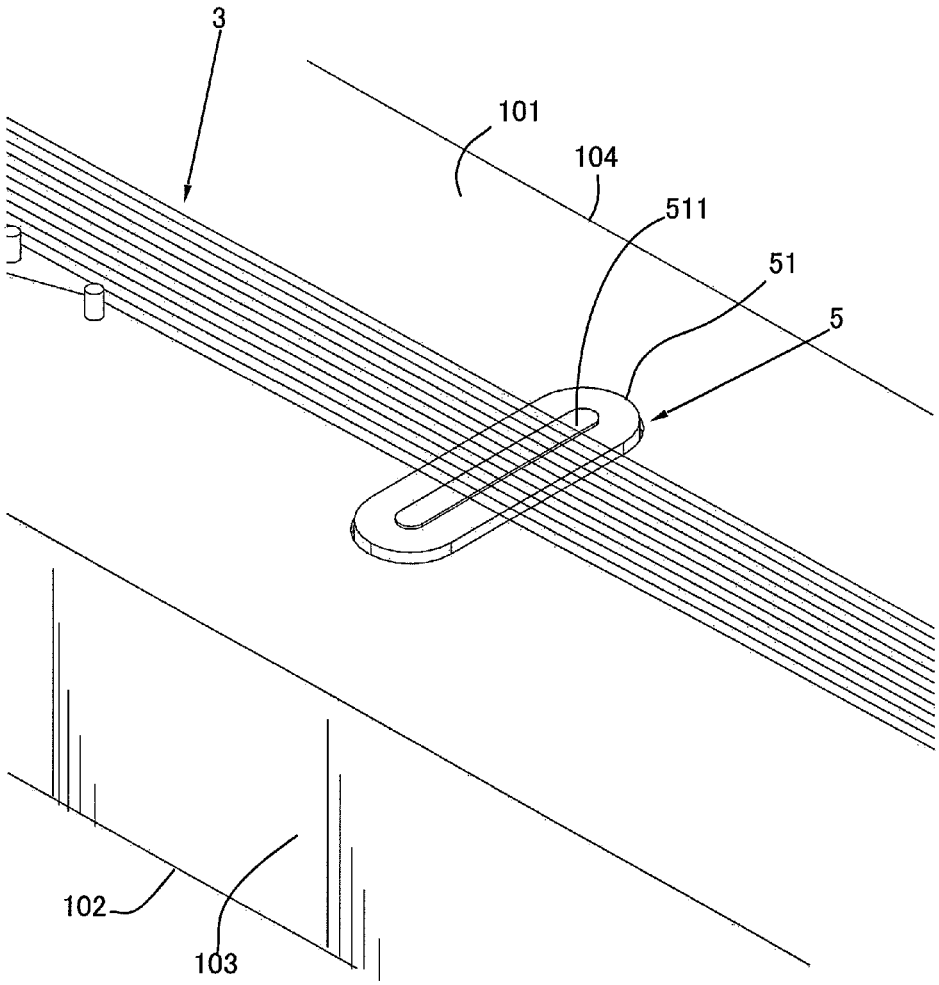
FIG. 14 is an enlarged perspective view showing a string exciting device of the stringed instrument of FIG. 13.

Also in an embodiment shown in FIGS. 13 and 14, the string exciting device 5 has an exciter 51 including an electromagnetic coil, but its core end 511 capable of exerting an effect on the strings 3 is exposed on the exterior surface of the top panel 101 where the strings 3 and the bridge 7 are disposed. The most part of the electromagnetic coil of the exciter 51 is located in the internal space 100 of the body 1, and only the core end 511 is passed through a through-hole formed in the top panel 101 to appear on the exterior surface. Thus, a magnetic force emitted from the core end 511 of the electromagnetic coil of the exciter 51 directly acts on and vibrates the strings 3 without the top panel 101 therebetween.

Figure 15:
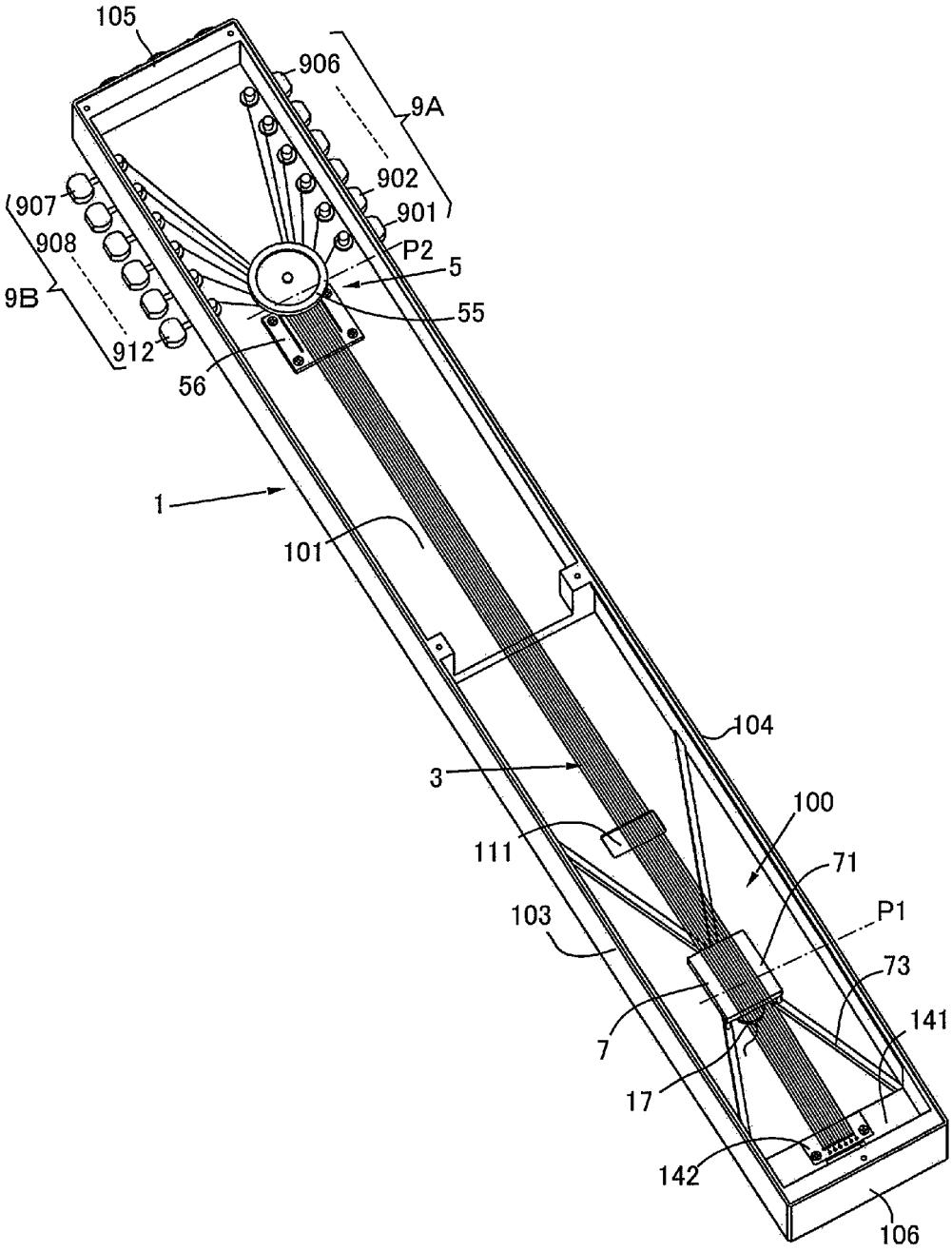
FIG. 15 is a perspective view showing another embodiment of the stringed instrument according to the present invention with its bottom panel removed.
Figure 16:
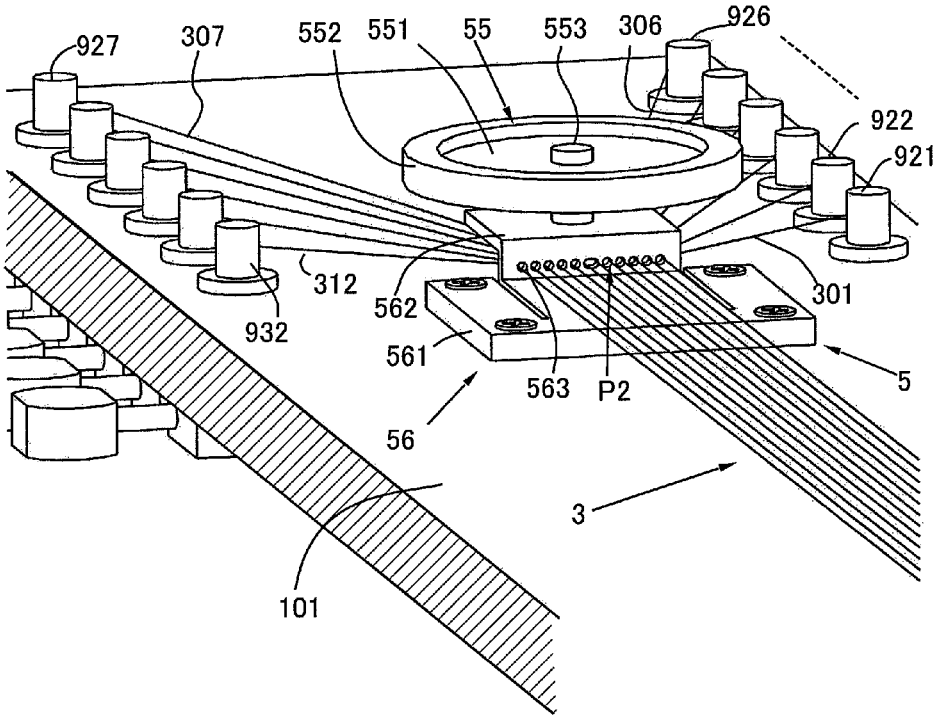
FIG. 16 is an enlarged perspective view showing a string exciting device of the stringed instrument of FIG. 15 with its side panel removed.

Next will be described a stringed instrument shown in FIGS. 15 and 16. The embodiment shown in FIGS. 15 and 16 is characterized in that the string exciting device 5 has an exciter 55 comprising a piezoelectric vibrator. The piezoelectric vibrator of the exciter 55 has a disk-like piezoelectric substrate 551 rimmed with a ring 552 that serves as a weight, wherein piezoelectric vibration is taken out through a vibration rod 553 connected to the center of the piezoelectric; substrate 551. However, the piezoelectric vibrator of the exciter 55 is not limited to the illustrated one.

The exciter 55 is supported by a support 56 fixed to the interior surface of the top panel 101. The support 56 may comprise an inorganic material such as metal, an organic material such as synthetic resin or a combination thereof. The support 56 has an anchor part 561 fixed to the interior surface of the top panel 101 and a vibration transmitting part 562 projecting from one end of the anchor part 561. To the vibration transmitting part 562, connected is one end of the vibration rod 553 of the piezoelectric vibrator of the exciter 55. In addition, through-holes 563 allowing passage of the strings 3 (301 to 312) are formed in a rising part of the vibration transmitting part 562.

The strings 3 (301 to 312) after passing through the through-holes 563 are divided into two groups: the strings 301 to 306 are led toward the side panel 104 and firmly wound around take-up shafts 921 to 926; the strings 307 to 312 are led toward the side panel 103 and firmly wound around take-up shafts 927 to 939.

In the embodiment shown in FIGS. 15 and 16, when the exciter 55 including a piezoelectric vibrator is driven by an electrical signal, electrostrictive vibration generated in the piezoelectric vibrator of the exciter 55 is transmitted to the vibration transmitting part 1562 through, the vibration rod 553. Then, the strings 3 (301 to 312) passing through the through-holes 563 formed in the rising part of the vibration transmitting part 562 are vibrated by the vibration transmitting part 562. The first support point P1 of the string 3 is located on the surface 71 of the bridge 7, while the second support point P2 is determined by the position of the through-hole 563 formed in the rising part of the vibration transmitting part 562.

The embodiment shown in FIGS. 15 and 16 has the same structure and effect as that shown in FIGS. 1 to 5, except that the piezoelectric vibrator is used in place of the electromagnetic coil in the embodiment shown in FIGS. 1 to 5.

Figure 17:
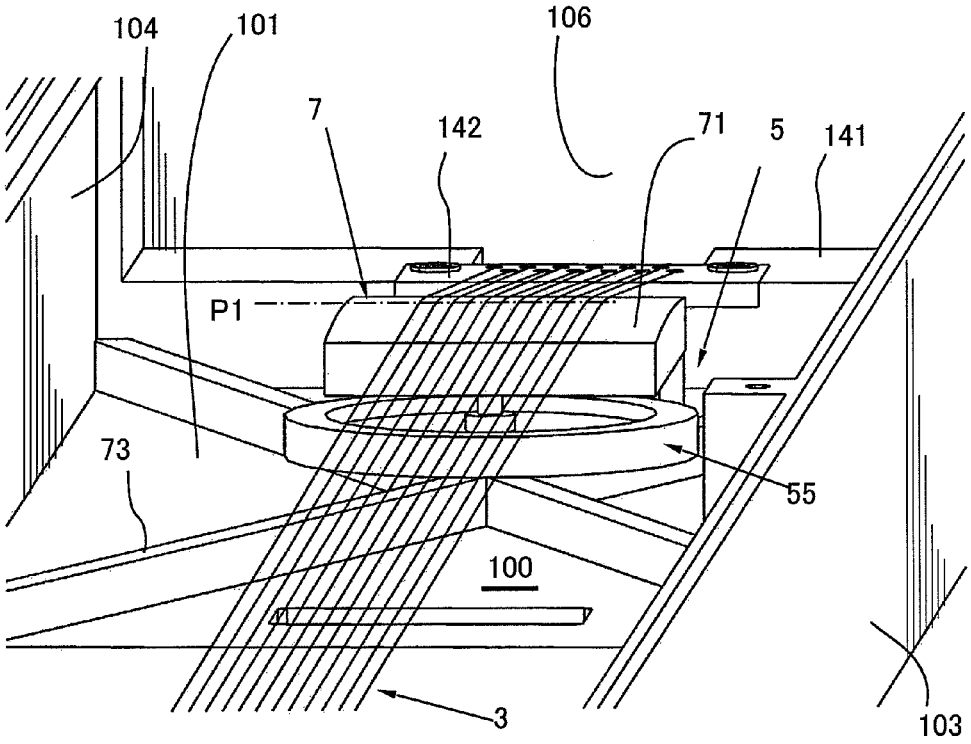
FIG. 17 is a drawing showing a string exciting device and a bridge used in another embodiment of the stringed instrument according to the present invention.
Figure 18:
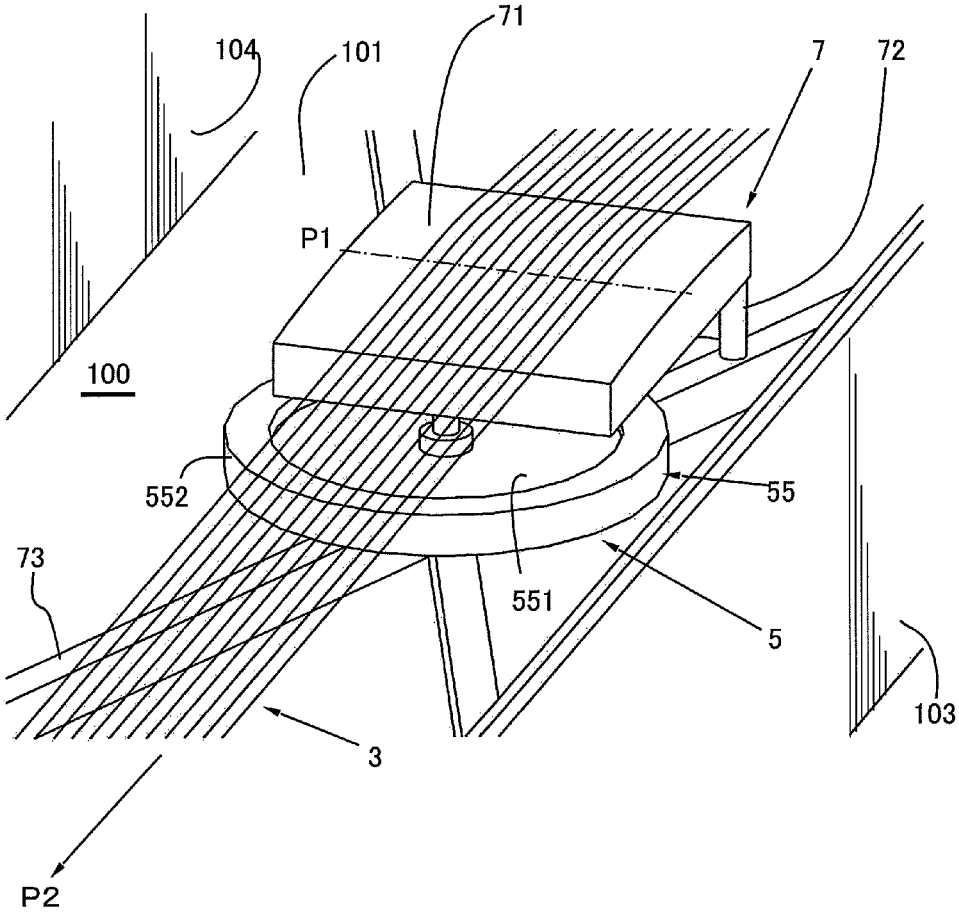
FIG. 18 is an enlarged view showing the string exciting device and the bridge of FIG. 17.

In an embodiment shown in FIGS. 17 and 18, although the exciter 55 of the string exciting device 5 has a piezoelectric vibrator, as in the embodiment shown in FIGS. 15 and 16, the bridge 7 is vibrated by the piezoelectric vibrator of the exciter 55 so as to vibrate, the strings 3 by the vibration of the bridge 7. Although not shown in the drawings, it is also possible to vibrate the top panel 101 of the body 1 by the piezoelectric vibrator of the exciter 55 so as to indirectly vibrate the strings 3 by the vibration of the body 1. In FIG. 18, the arrow P2 indicates the area where the second support points P21 to P32 are arranged.

Figure 19:
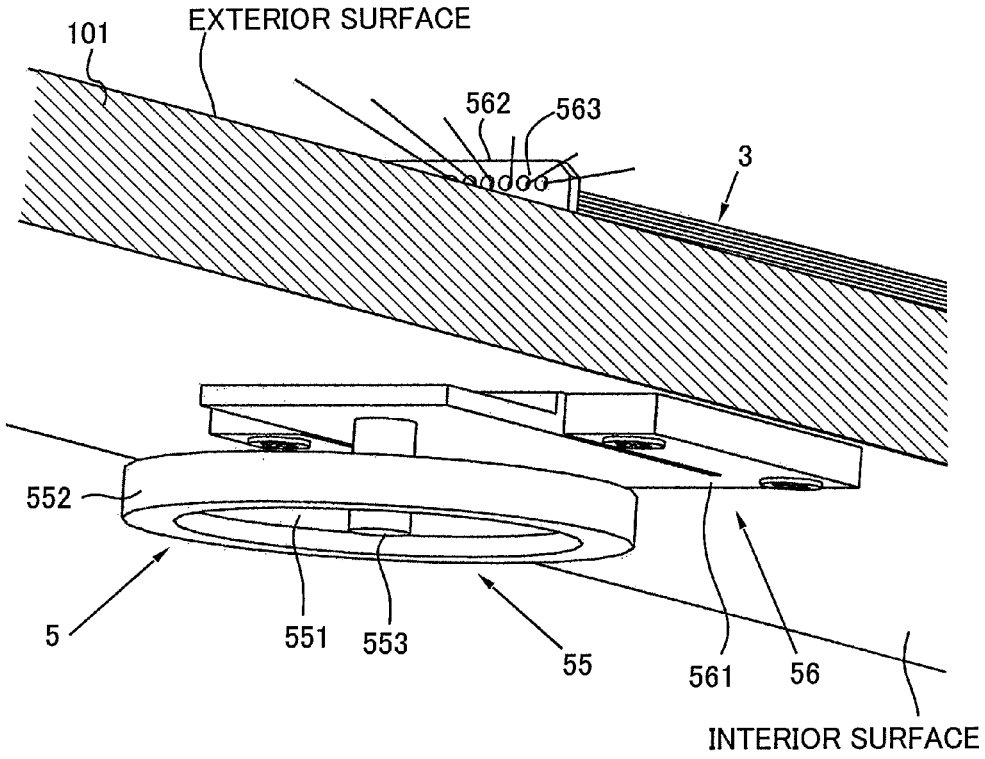
FIG. 19 is an enlarged perspective view showing another string exciting device of the stringed instrument with its side panel omitted.
Figure 20:
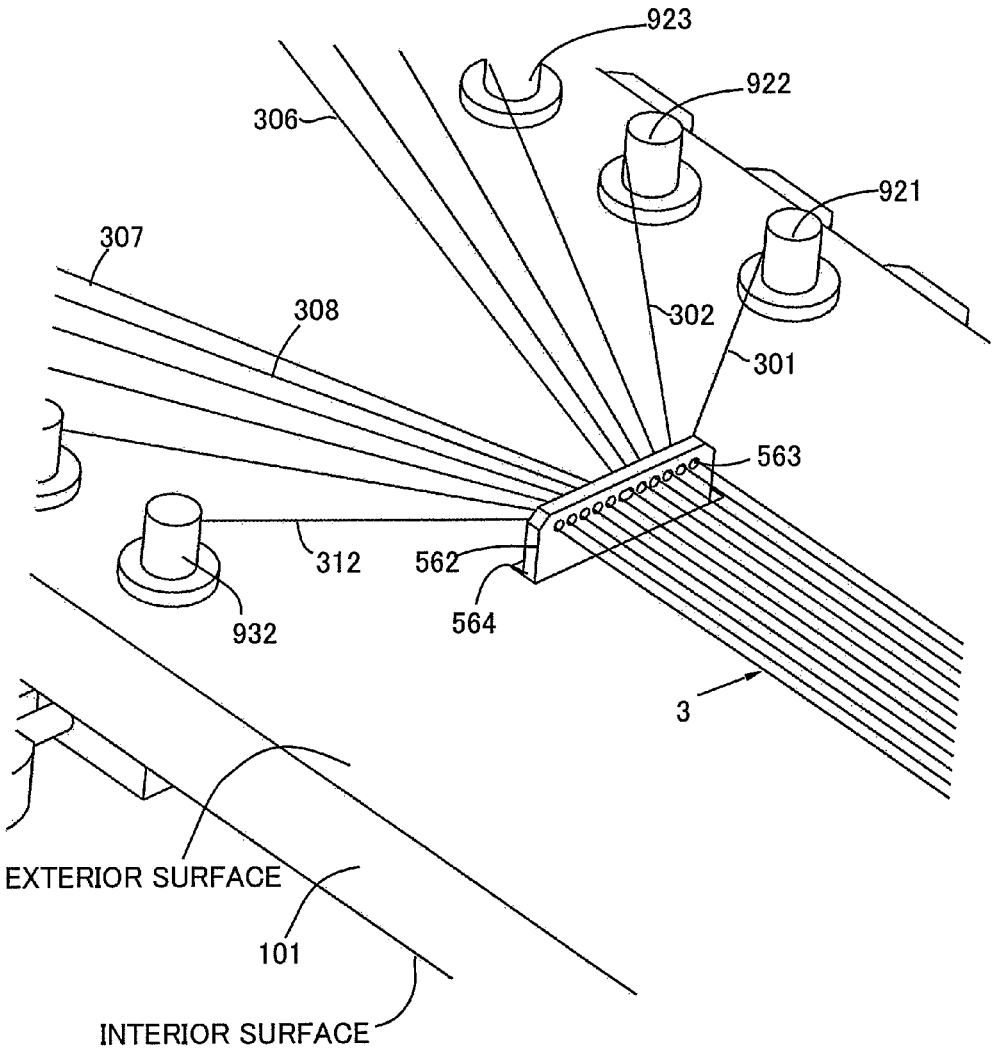
FIG. 20 is a perspective view in which the string exciting device of FIG. 19 is seen from the top side.

In an embodiment shown in FIGS. 19 and 20, the exciter 55 of the string exciting device 5 has a piezoelectric vibrator, and one end of the vibration transmitting part 562 capable of exerting an effect on the strings 3 is exposed on the exterior surface of the top panel 101 where the strings $ and the bridge 7 are disposed. The exciter 55 and the support 56 constituting the string exciting device 5 have the same structure as described with reference to FIG. 16, wherein the most part is disposed in the internal space 100 of the body 1, i.e., on the side of the interior surface opposite from the exterior surface where the strings 3 and the bridge 7 are disposed, and only is one end of the vibration transmitting part 562 is passed through a through-hole 564 (see FIG. 20) formed in the top panel 101 to appear on the exterior surface. Then, the strings 3 passing through the through-holes 563 are vibrated by the vibration of the vibration transmitting part 562 driven by the exciter 55.

In the exciters 55 shown in FIGS. 15 to 20, an electromagnetic coil, a magnetostrictive vibrator or a giant magnetostrictive vibrator may be used, in place of the piezoelectric vibrator. In the case of using the electromagnetic coil, as already suggested in the embodiment shown in FIG. 9 and its explanation, the whole support 56 may comprise a magnetic material or at least a part of the vibration transmitting part 562, opposed to the electromagnetic coil of the exciter 55 may comprise, partially or entirely, a magnetic material. In the case of using the magnetostrictive vibrator or the giant magnetostrictive vibrator, the support. 56 need not comprise a magnetic material and may comprise am inorganic material such as metal, an organic material such as synthetic resin or a combination thereof.

Figure 21:
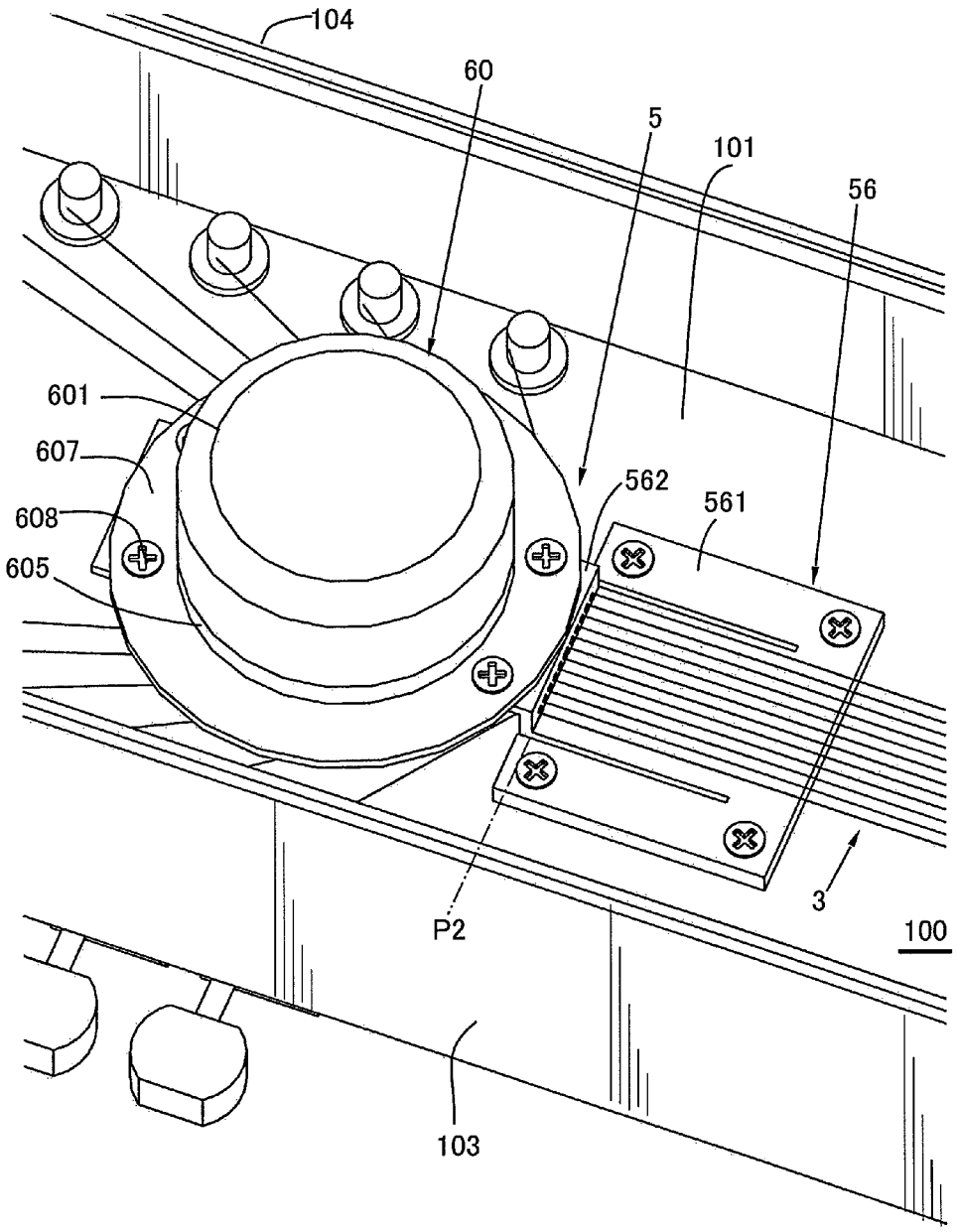
FIG. 21 is an enlarged external perspective view showing a string exciting device in still another embodiment of the stringed instrument according to the present invention.

In another embodiment shown in FIG. 21, the vibration transmitting part 562 of the support 56 disposed on the interior surface of the to panel 101 is vibrated by an exciter 60 to indirectly vibrate the strings 301 to 312 passing through the through-holes 563 formed in the rising part of the vibration transmitting part 562. The support 56 need not, comprise a magnetic material and may comprise an inorganic material such as metal, an organic material such as synthetic resin or a combination thereof.

Figure 22:
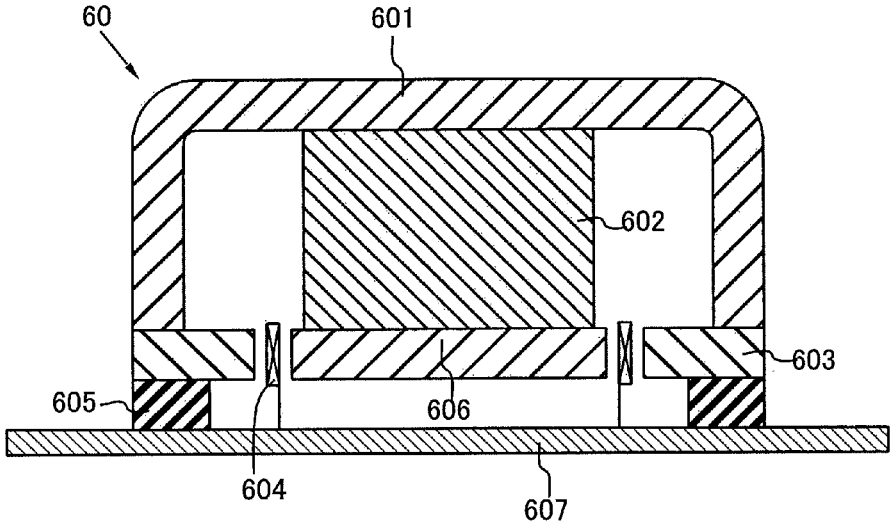
FIG. 22 is a sectional view showing an exciter (voice coil) suitable as a component of the string exciting device of FIG. 21.
Figure 23:
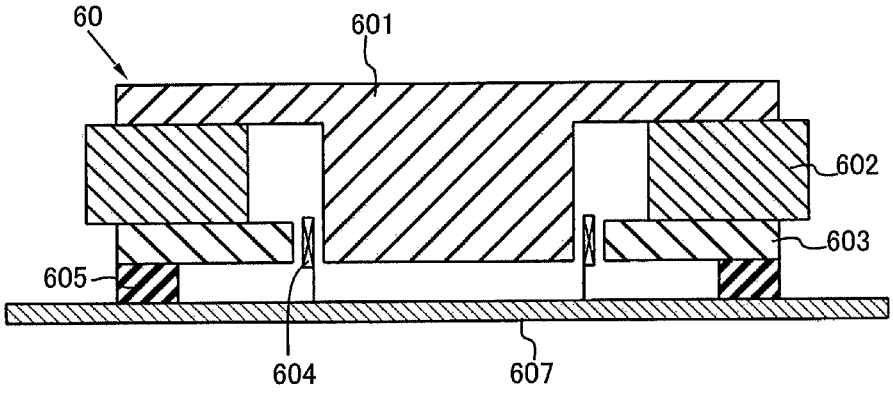
FIG. 23 is a sectional view showing another exciter (voice coil) suitable as a component of the string exciting device.

FIGS. 22 and 23 are drawings showing a concrete structure of the exciter 60. In either case, the exciter 60 is a voice coil exciter. In the exciter 60 shown in FIG. 22, a ring-shaped second yoke 603 is disposed on an end face of a tubular part of a cap-shaped first yoke 601, a third yoke 606 is disposed on an end face of a permanent magnet 602 located at the center of the first yoke 601, and a coil 604 is disposed in a space formed between the third yoke 606 and the second yoke 603. Beneath the second yoke 603, there is disposed a damper 605 comprising an elastic material. The damper 605 is fixed to a mounting plate 607.

In the embodiment shown in FIG. 21, employed is the exciter 60 shown in FIG. 22, and the mounting plate 607 is fixed to the vibration transmitting part 562, for example, by screws 608.

In the voice coil exciter 60 shown in FIG. 23, a ring-shaped magnet 602 is disposed between a first yoke 601 and a ring-shaped second yoke 603. The first yoke 601 has a central yoke portion within a central hole defined by the ring-shaped magnet 602 and the ring-shaped second yoke 603, and a coil 604 is disposed in a ring-shaped space formed between the inner peripheral surface of the ring-shaped second yoke 603 and the first yoke 601. Between the second yoke 603 and the support, there is disposed a damper 605. However, the voice coil exciter 60 is not limited to those shown in FIGS. 22 and 23 and may be of various types.

Figure 24:
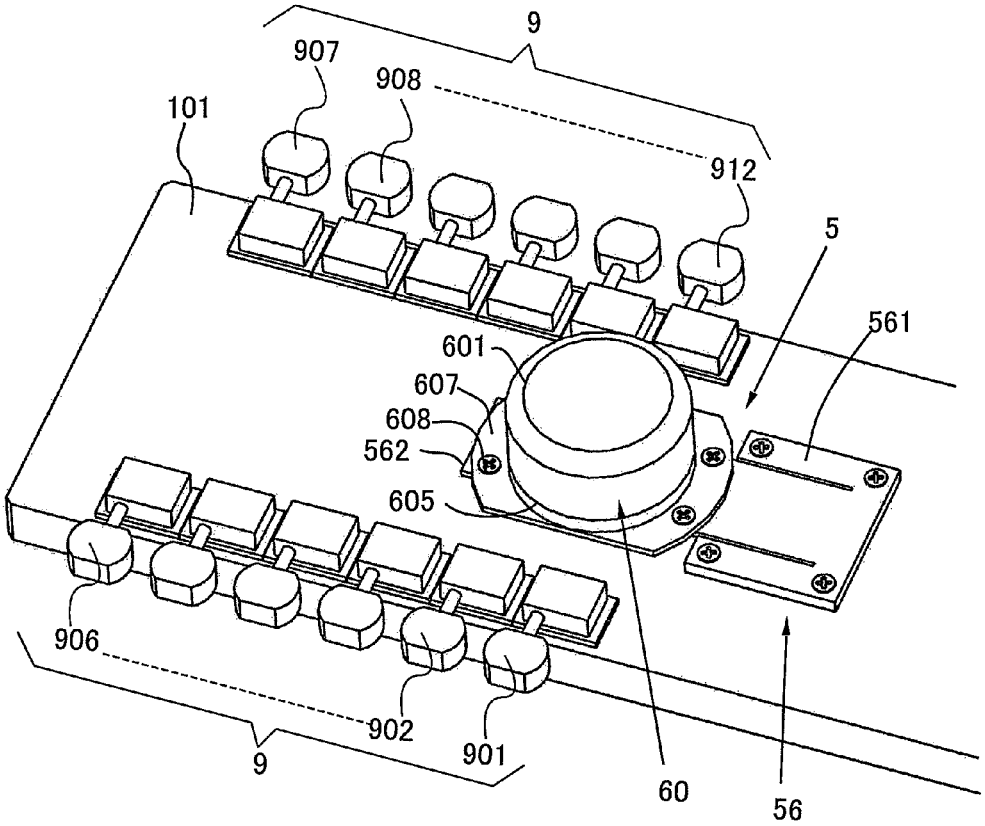
FIG. 24 is a perspective view showing still another embodiment of the stringed instrument according to the present invention with its side panel omitted.

In FIG. 24, furthermore, the piezoelectric vibrator of the string exciting device 5 in the embodiment shown in FIGS. 19 and 20 is replaced with the voice coil exciter 60, wherein the strings 3 are vibrated by the vibration of the vibration transmitting part 562 driven by the voice coil exciter 60.

Figure 25:
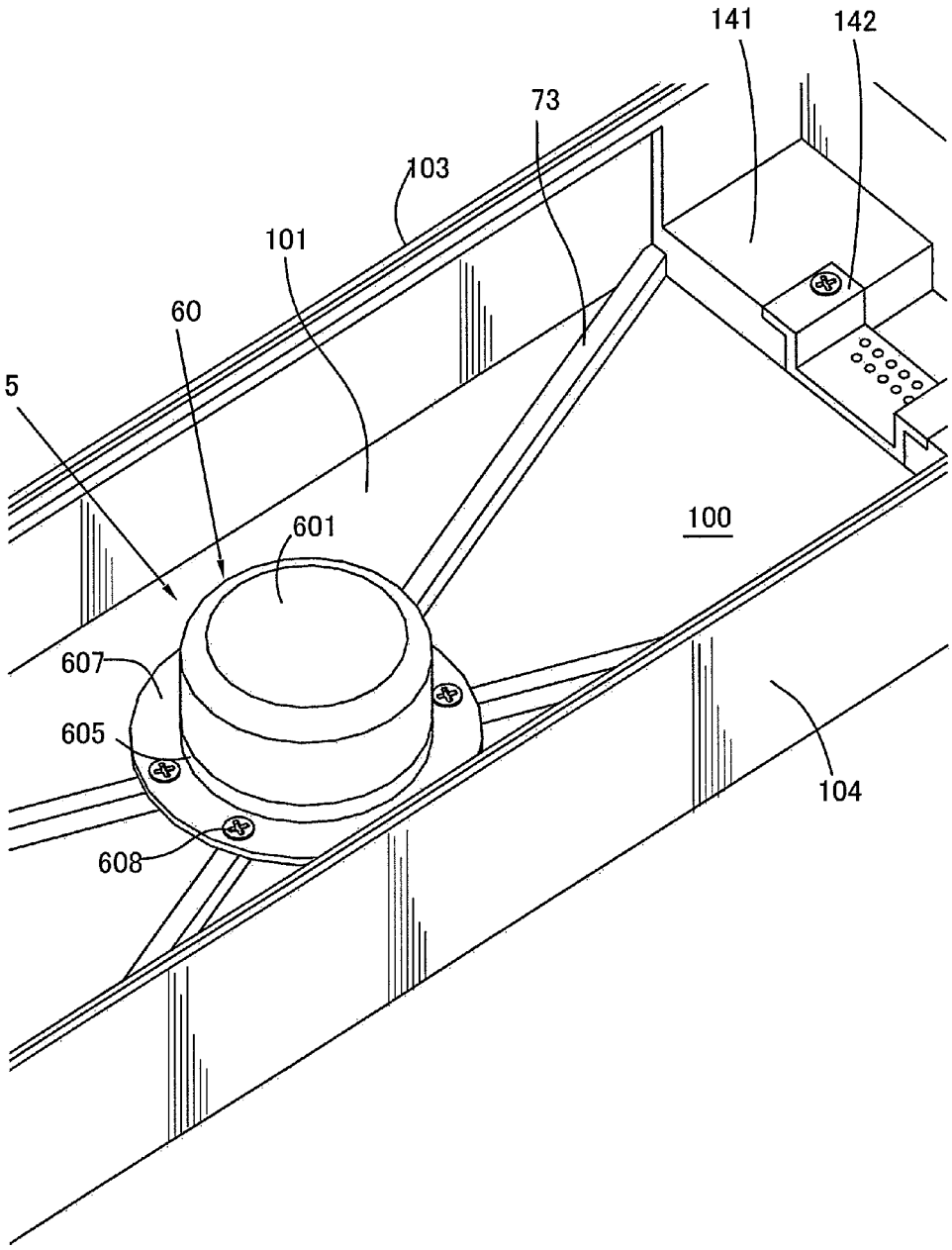
FIG. 25 is a perspective view showing still another embodiment of the stringed instrument according to the present invention.

FIG. 25 shows an embodiment in which the body 1, e.g., the top panel 101 is vibrated by the string exciting device 5 having the voice coil exciter 60 to indirectly vibrate the strings by the vibration of the body 1.

Figure 26:
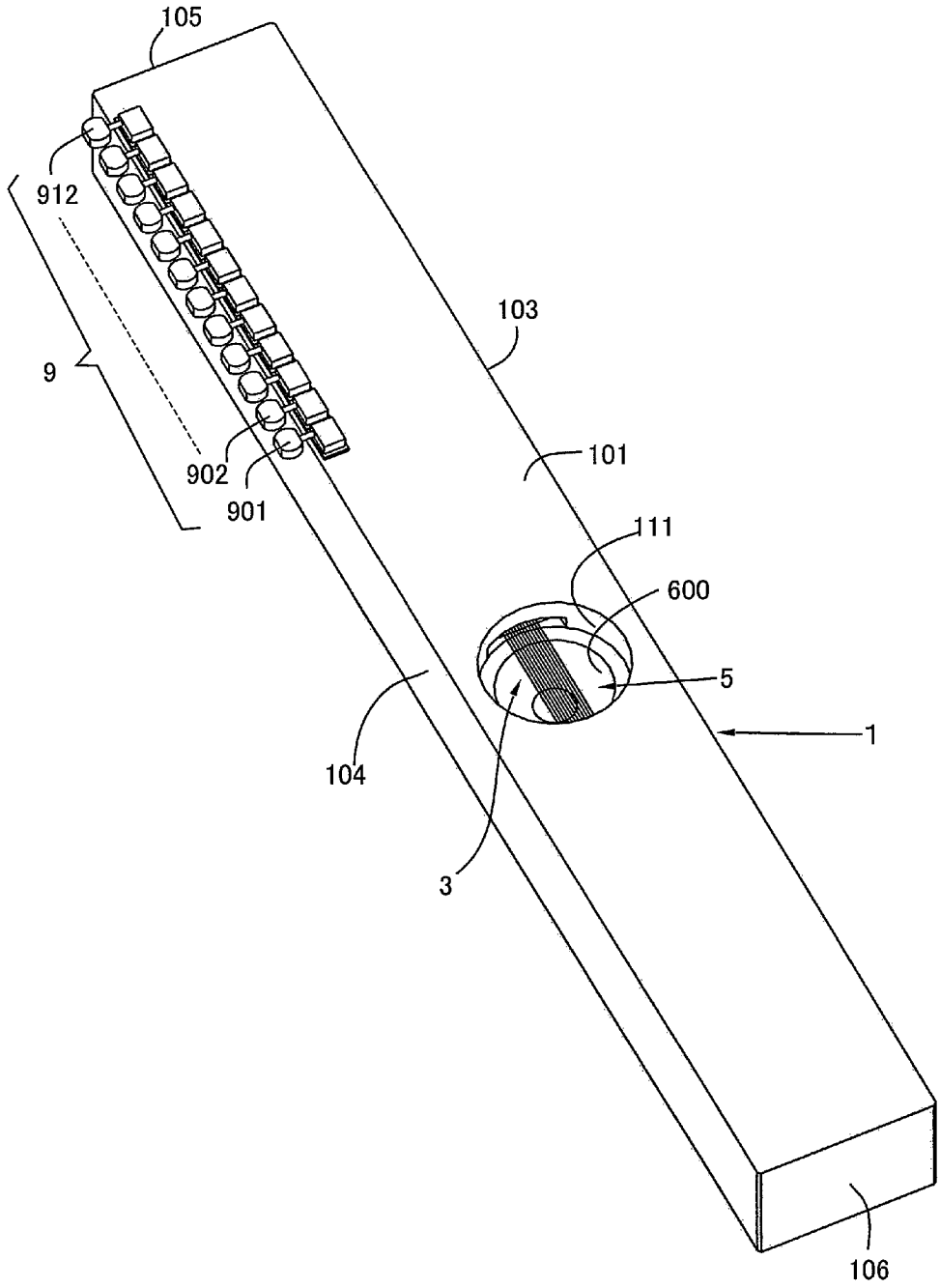
FIG. 26 is an external perspective view showing still another embodiment of the stringed instrument according to the present invention.
Figure 27:
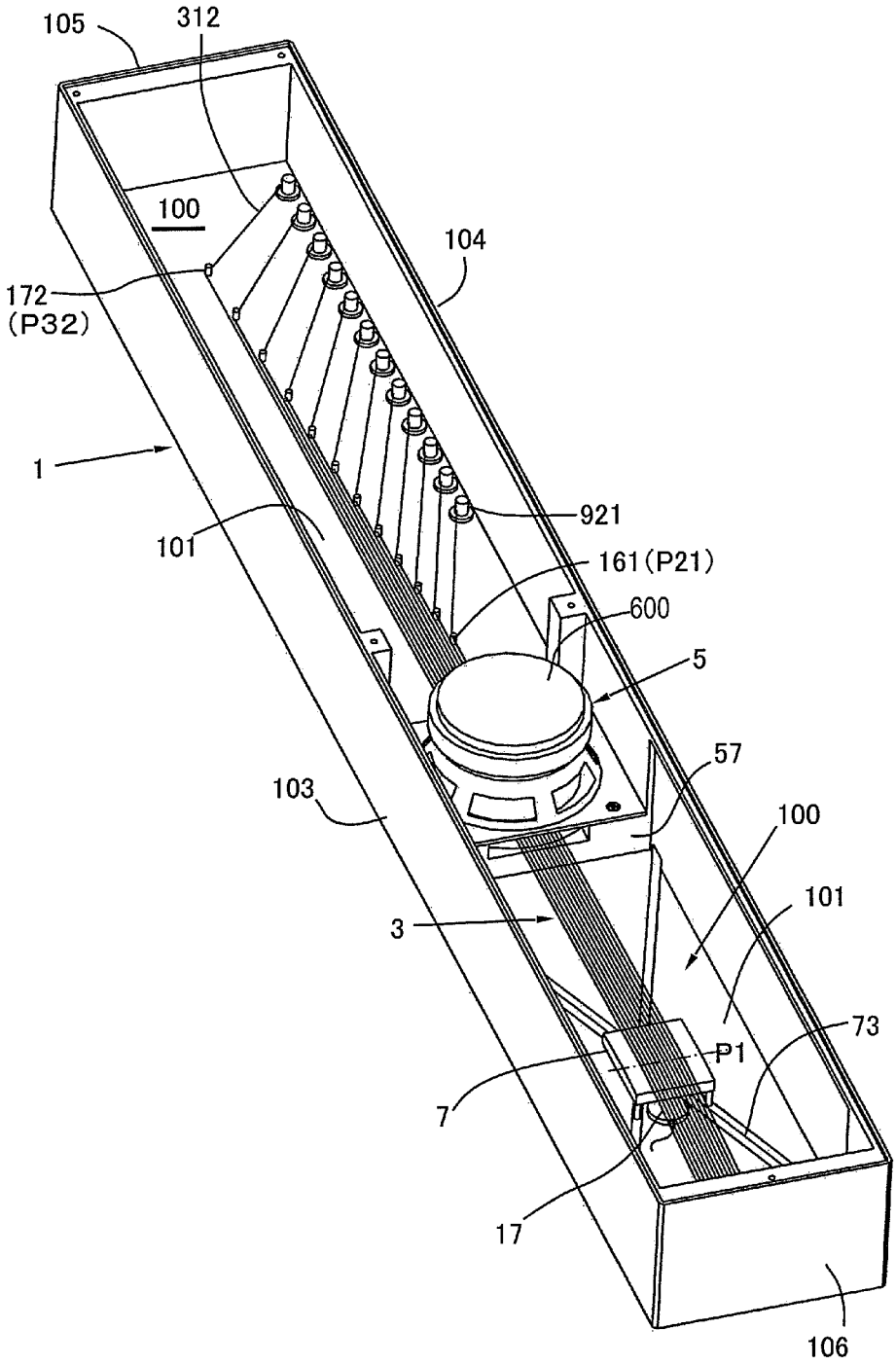
FIG. 27 is a perspective view showing the stringed instrument of FIG. 26 with its bottom panel removed.
Figure 28:
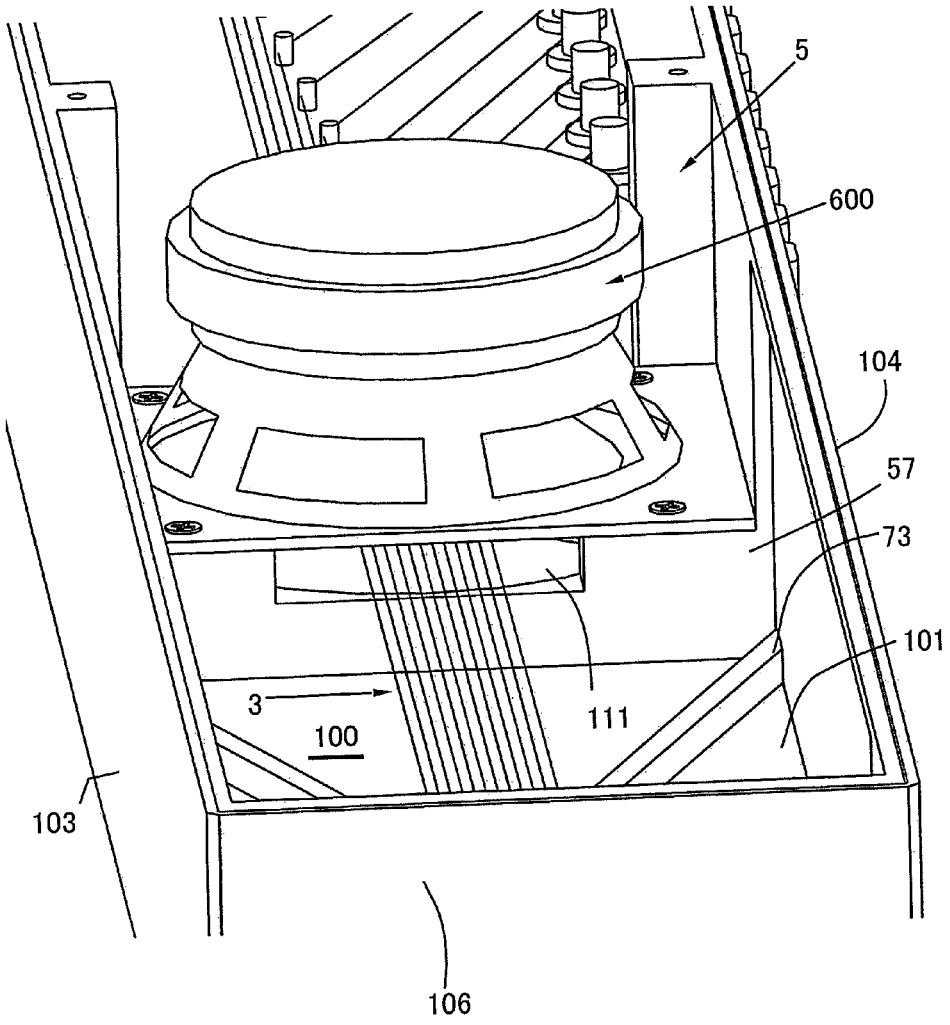
FIG. 28 is an enlarged perspective view showing a string exciting device, of the stringed instrument of FIG. 27.

In another embodiment shown in FIGS. 26 to 28, a speaker 600 is disposed in the internal space 100 of the body 1 to face the strings 3, wherein the strings 3 tensioned in the internal space 100 of the body 1 are vibrated by a sound pressure from the speaker 600. The top panel 101 has a sound hole 111 in front of the speaker 600. The speaker 600 is mounted on a support 57 disposed on the interior surface of the top panel 101.

Figure 29:
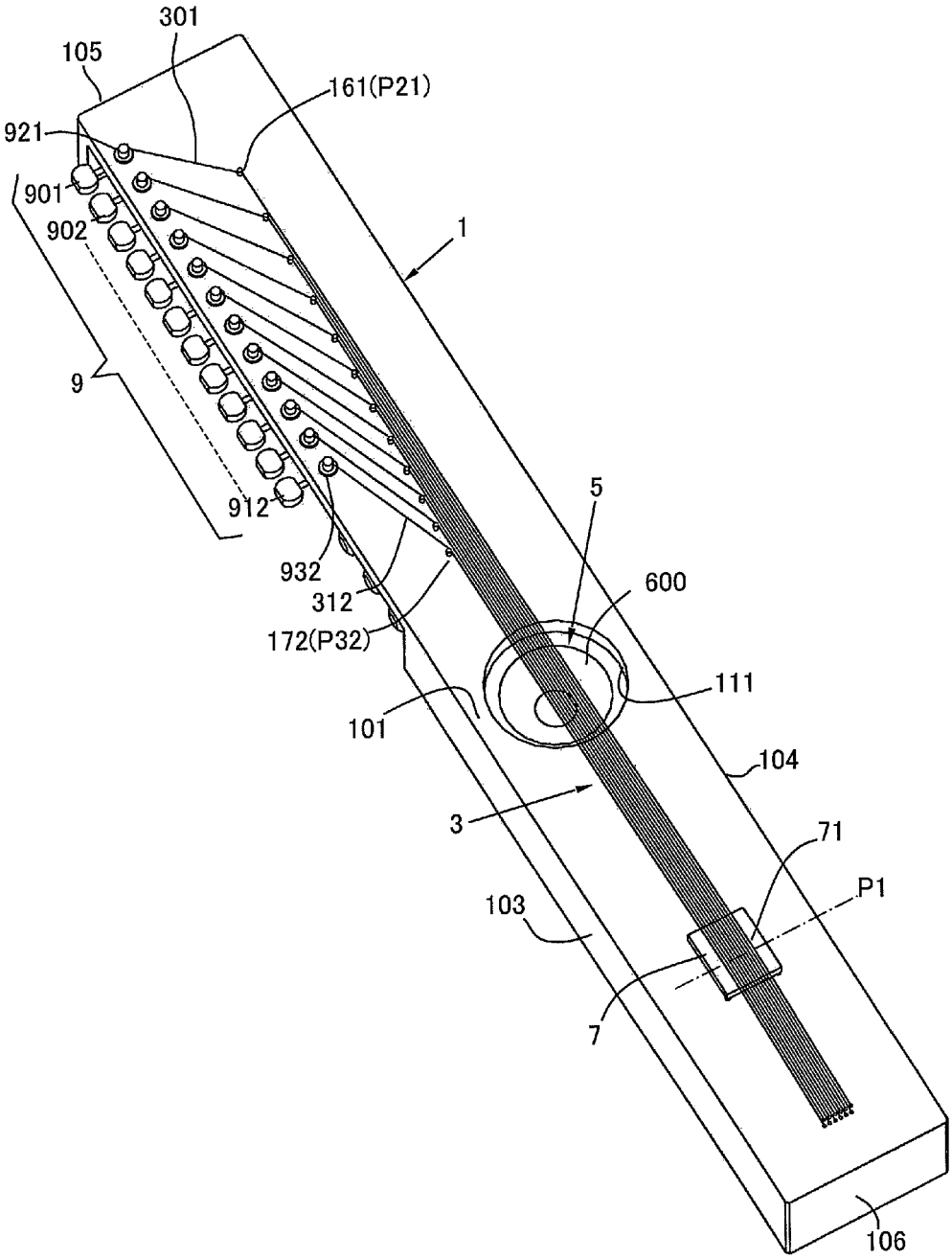
FIG. 29 is an external perspective view showing still another embodiment of the stringed instrument according to the present invention.
Figure 30:
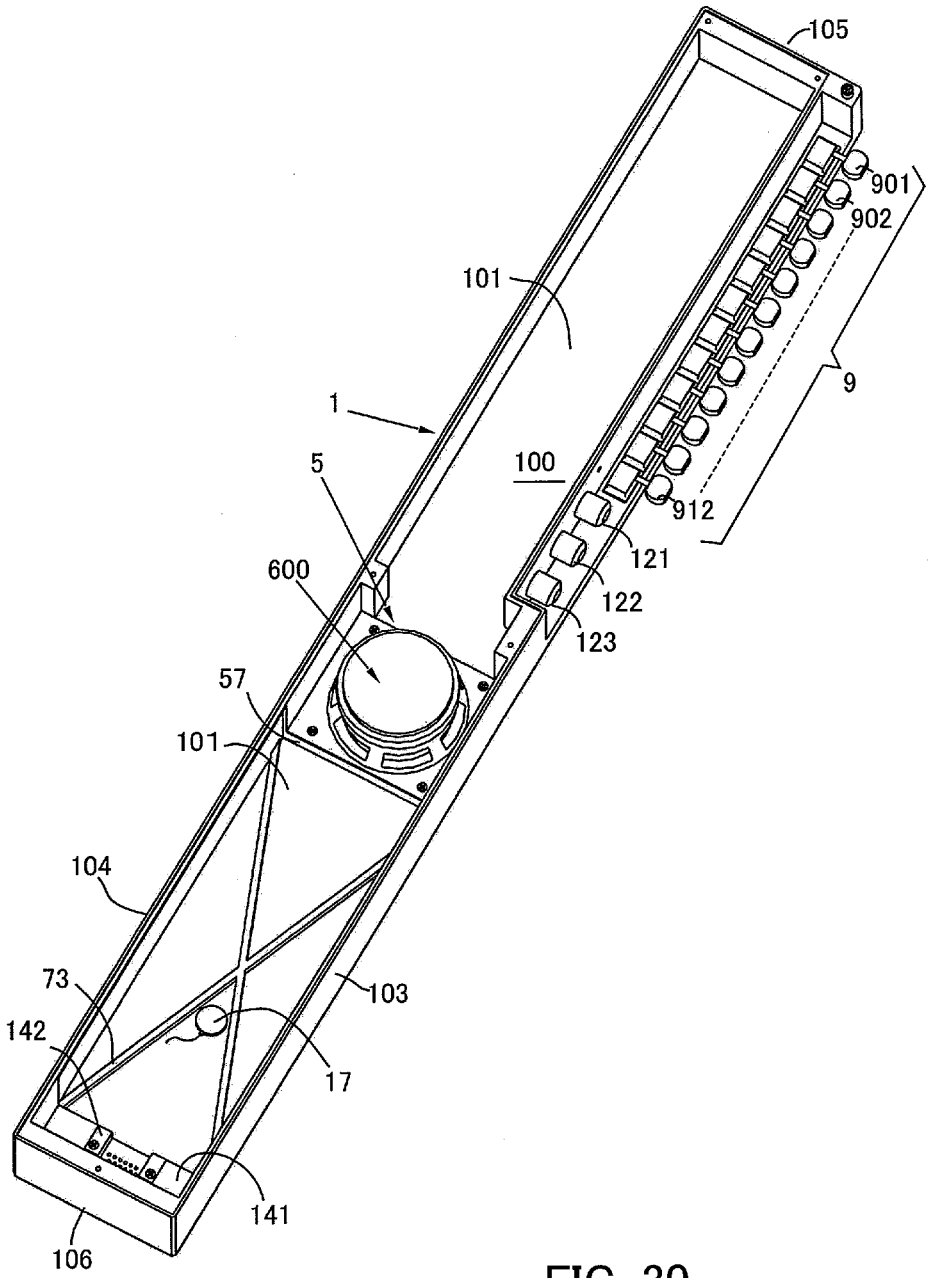
FIG. 30 is a perspective view showing the stringed instrument of FIG. 29 with its bottom panel removed.

In another embodiment shown in FIGS. 29 and 30, the bridge 7 has the first support point P1 and the surface 71 located between the first support point P1 and the second support points P21 to P32 and designed to come into contact with the strings 3 during vibration of the strings 3. In the internal space 100 of the body 1, the speaker 600 is disposed to face the strings 3, wherein the strings 3 tensioned on the exterior surface of the top panel 101 of the body 1 are vibrated by a sound pressure from the speaker 600. The top panel 101 has a sound hole 111 in front of the speaker 600. The speaker 600 is mounted on a support 57 that forms a part of the interior surface of the top panel 101 (see FIG. 30).

Also in the embodiments shown in FIGS. 9 to 30, since the bridge 7 is a jawari bridge 7 whose surface 71 intended to come into contact with the strings 3 is a convex surface, even the people who do not have the playing skills can enjoy a resonant sound with higher harmonic components, as with the sitar.

2. Second Type

Figure 31:
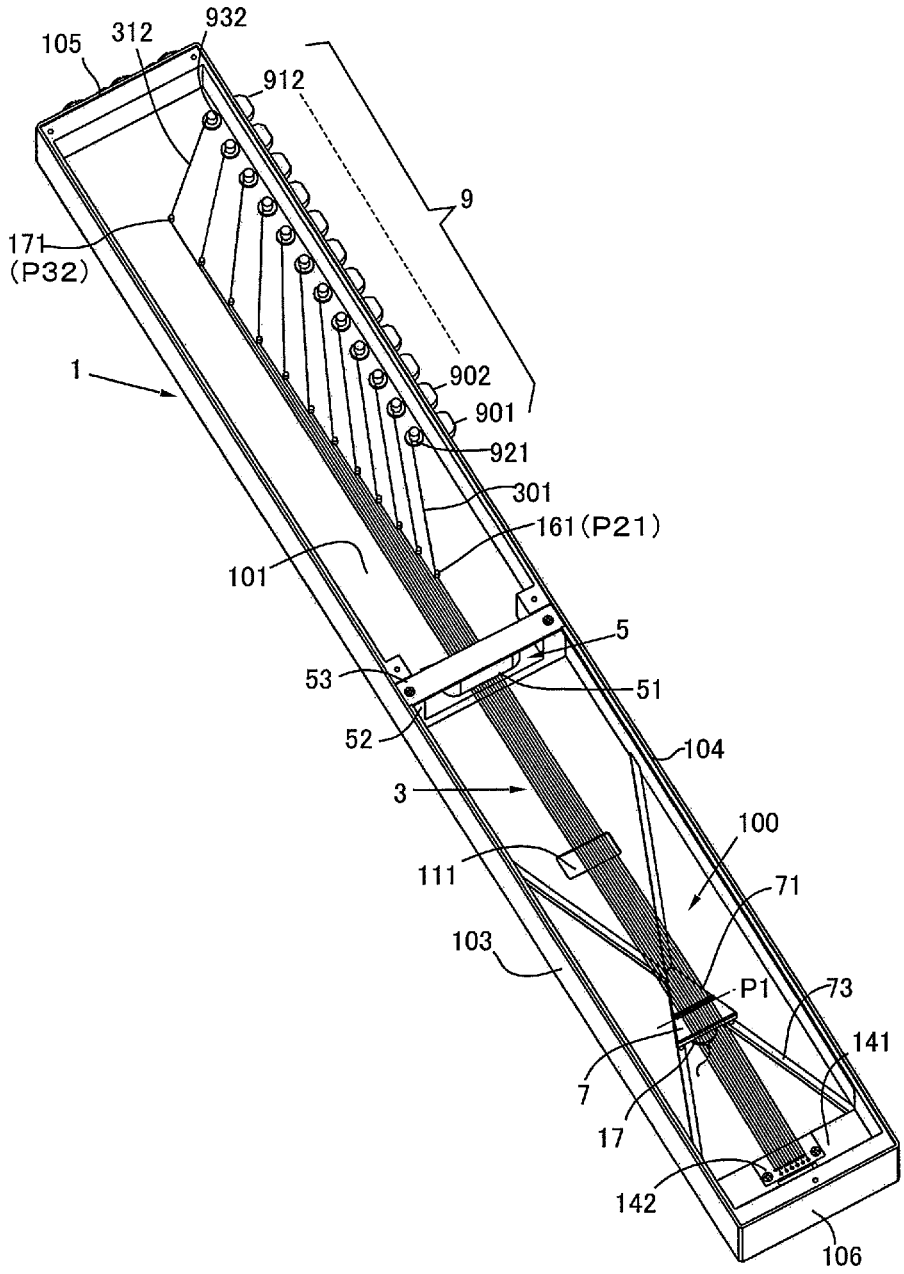
FIG. 31 is a perspective view showing another embodiment of the stringed instrument according to the present invention with its bottom panel removed.
Figure 32:
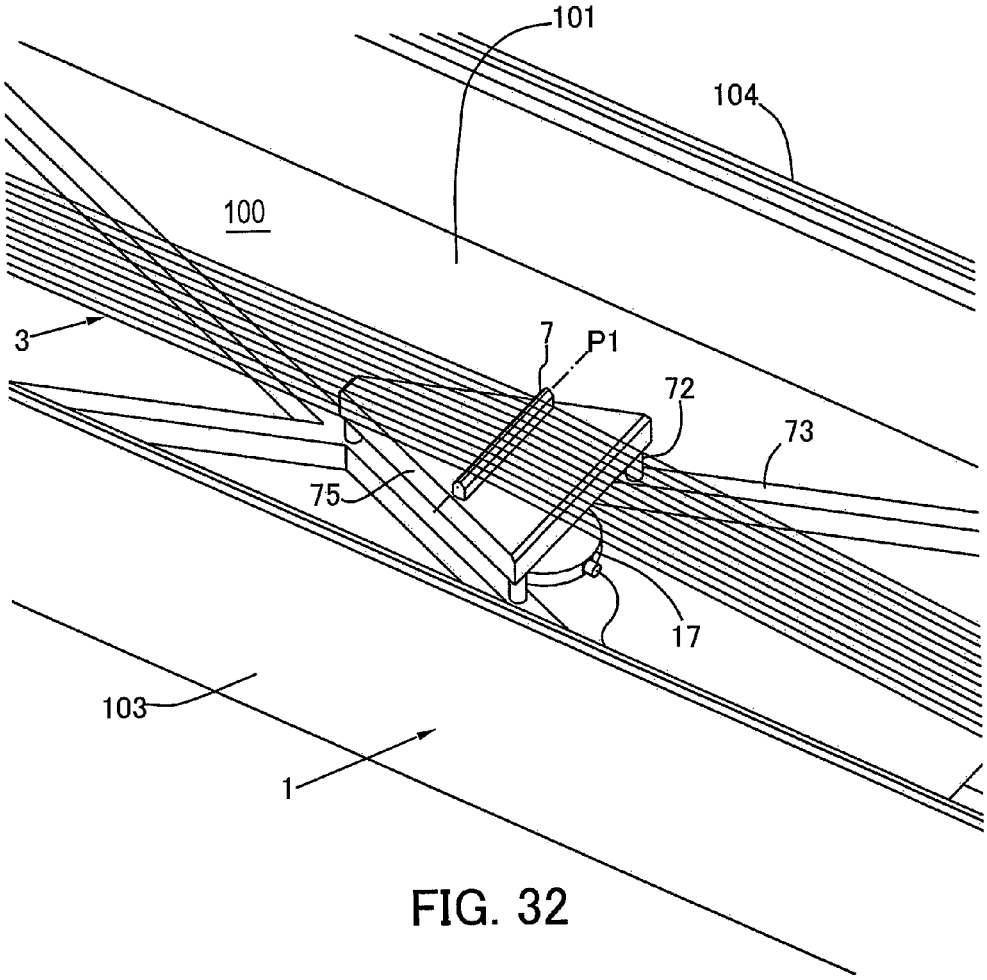
FIG. 32 is an enlarged perspective view showing a bridge in the stringed instrument of FIG. 31.
Figure 33:
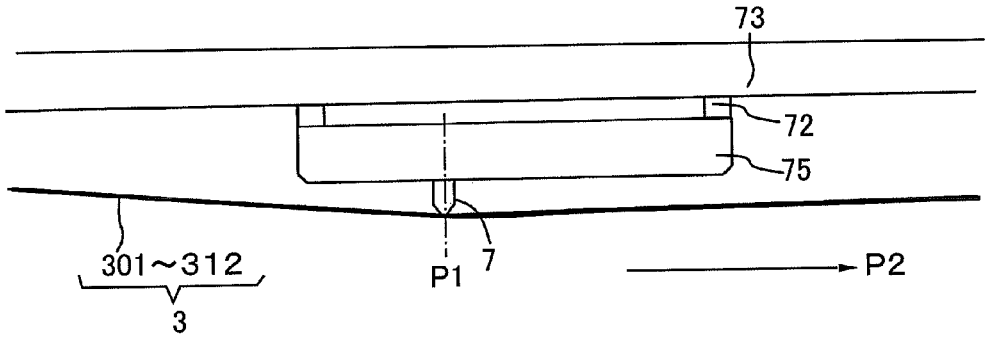
FIG. 33 is a drawing showing a relationship between the bridge and strings in FIG. 32.

In an embodiment shown in FIGS. 31 to 33, the bridge 7 has the first support point P1 but is configured not to come into contact with the strings 3 at any point between the first support point P1 and the second support point P2. As long as satisfying the above requirement, the end face of the bridge 7 may have any shape such as a blade shape, a flat shape or a curved shape. The bridge 7 is mounted on a support 75, and the support 75 is attached to a bracing 73 disposed on the interior surface of the top panel 101 with columns 72.

The bridge 7 thus configured supports each of the strings 301 to 312 at the first support point P1 but does not come into contact with the strings 3 during vibration of the strings 3 at any point between the first support point P1 and the second support point P2, so that people can enjoy a reverberant sound that will be generated from the strings 3 resonating at an excitation frequency applied from the string exciting device 5. Moreover, since the strings 3 are vibrated by the string exciting device 5, such a reverberant sound can be generated readily and adequately.

Furthermore, since the strings 3, the string exciting device 5 and the bridge 7 are disposed in the internal space 100 of the body 1, the risk of injury from touching a pointed end of the string 3 or being hit by a broken string 3 can be eliminated. There is also an advantage of facilitating the maintenance of the body 1, 3. Third Type In an embodiment shown in FIGS. 34 to 36, each string 3 (301 to 304) is provided with an exciter and as converter for converting its vibration to an electrical signal. More specifically, the strings 301 to 304 disposed on the interior surface of the top panel 101 of the body 1 are opposed to a first exciter 211, a second exciter 232, a third exciter 213 and a fourth exciter 234, respectively. The string 301 opposed to the first exciter 211 is also opposed to a first converter 221, the string 302 opposed to the second exciter 232 is also opposed to a second converter 242, the string 303 opposed to the third exciter 213 is also opposed to a third converter 223, and the string 304 opposed to the fourth exciter 234 is also opposed to a fourth converter 244. The first to fourth exciters 211 to 234 and the first to fourth converters 221 to 244 each comprise an electromagnetic coil.

In the illustrated embodiment, the first exciter 211, the third exciter 213, the first converter 221 and the third converter 223 are mounted on one side of a single support 215 to form a first assembly 21, and the support 215 of the first assembly 21 is fixed to mounting members 571, 572 standing on the interior surface of the top panel 101 along the interior surface of the side panels 103, 104. Similarly, the second exciter 232, the fourth exciter 234, the second converter 242 and the fourth converter 244 are mounted on one side of a single support 235 to form a second assembly 23, and at a distance from the first assembly 21, the support 235 of the second assembly 23 is fixed to the mounting members 571, 572 standing on the interior surface of the top panel 101 along the interior surface of the side panels 103, 104.

Pins 161 to 164 are located at the same position as seen in the longitudinal direction of the strings 3, so that the strings 3 (301 to 304) have the same scale length. In this case, a wide range can be covered by changing the tension, the linear density, etc. of the individual strings 301 to 304 in a stepwise manner.

The operation of the stringed instrument, according to the embodiment shown in FIGS. 34 to 36 will be described in detail with reference to FIGS. 39 to 41.

4. Circuit/Sound Information System

Figure 34:
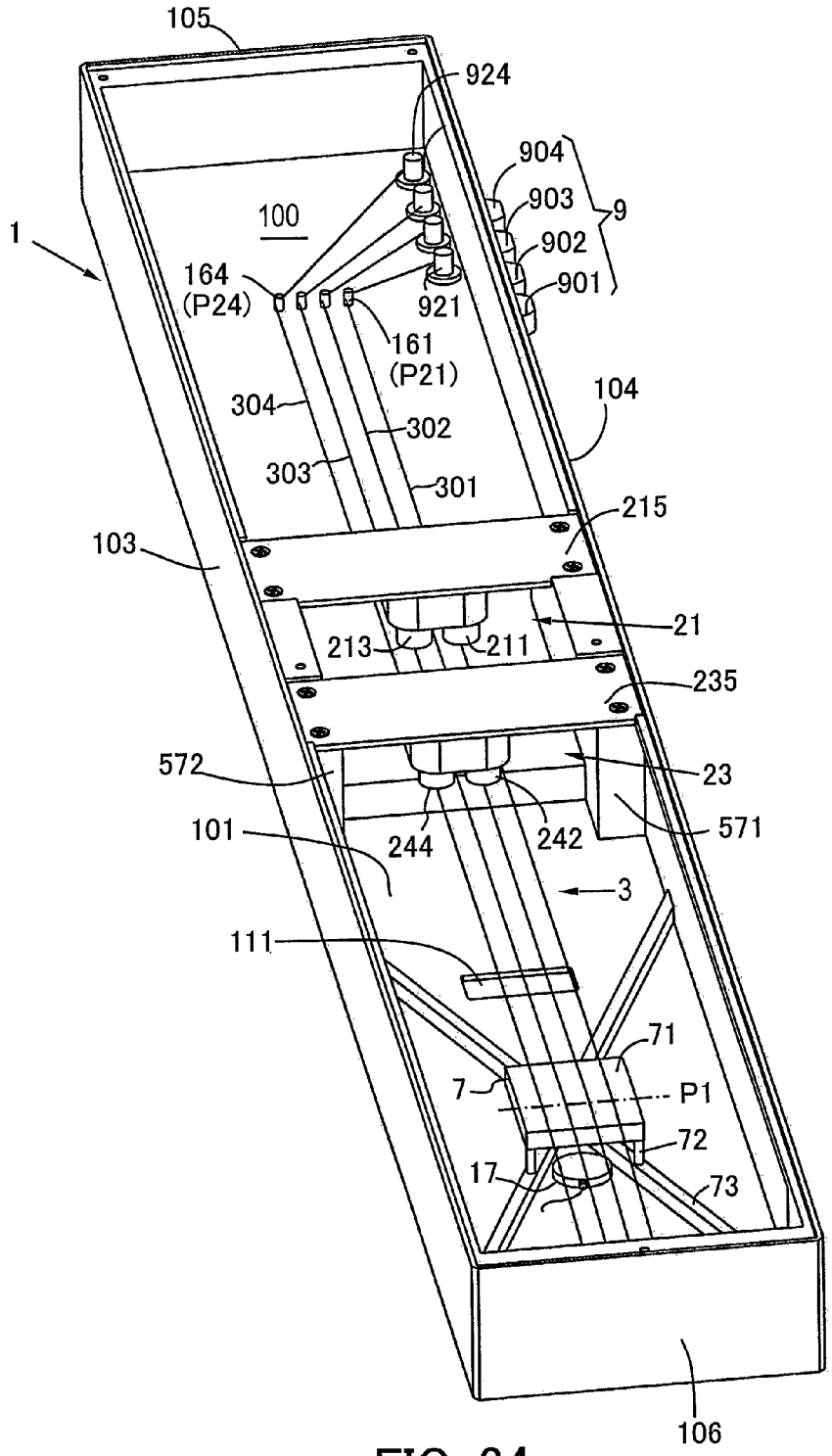
FIG. 34 is a perspective view showing still another embodiment of the stringed instrument according to the present invention with its bottom panel removed.
Figure 35:
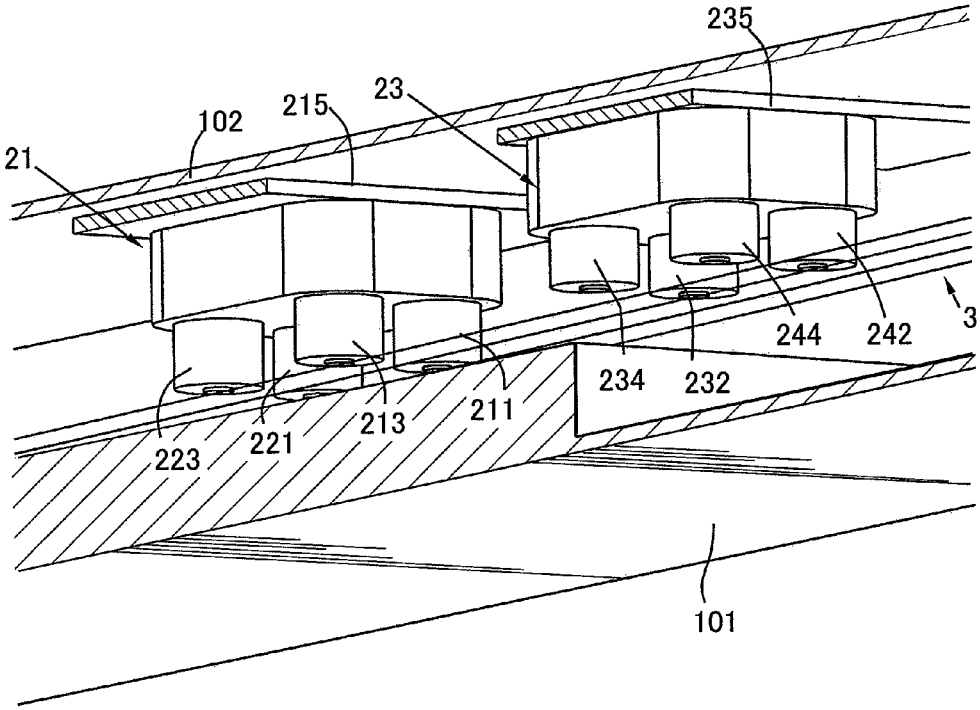
FIG. 35 is an enlarged perspective view showing an exciter-pickup structure in the stringed, instrument of FIG. 34.
Figure 36:
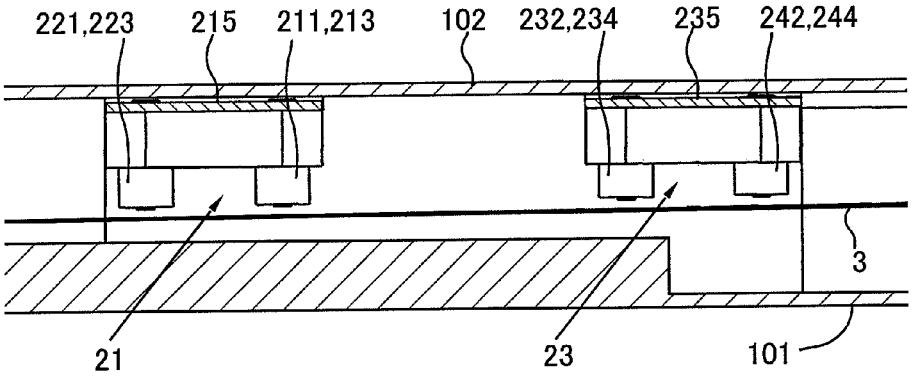
FIG. 36 is a drawing in which the exciter-pickup structure of FIG. 35 is seen from the lateral side.
Figure 37:
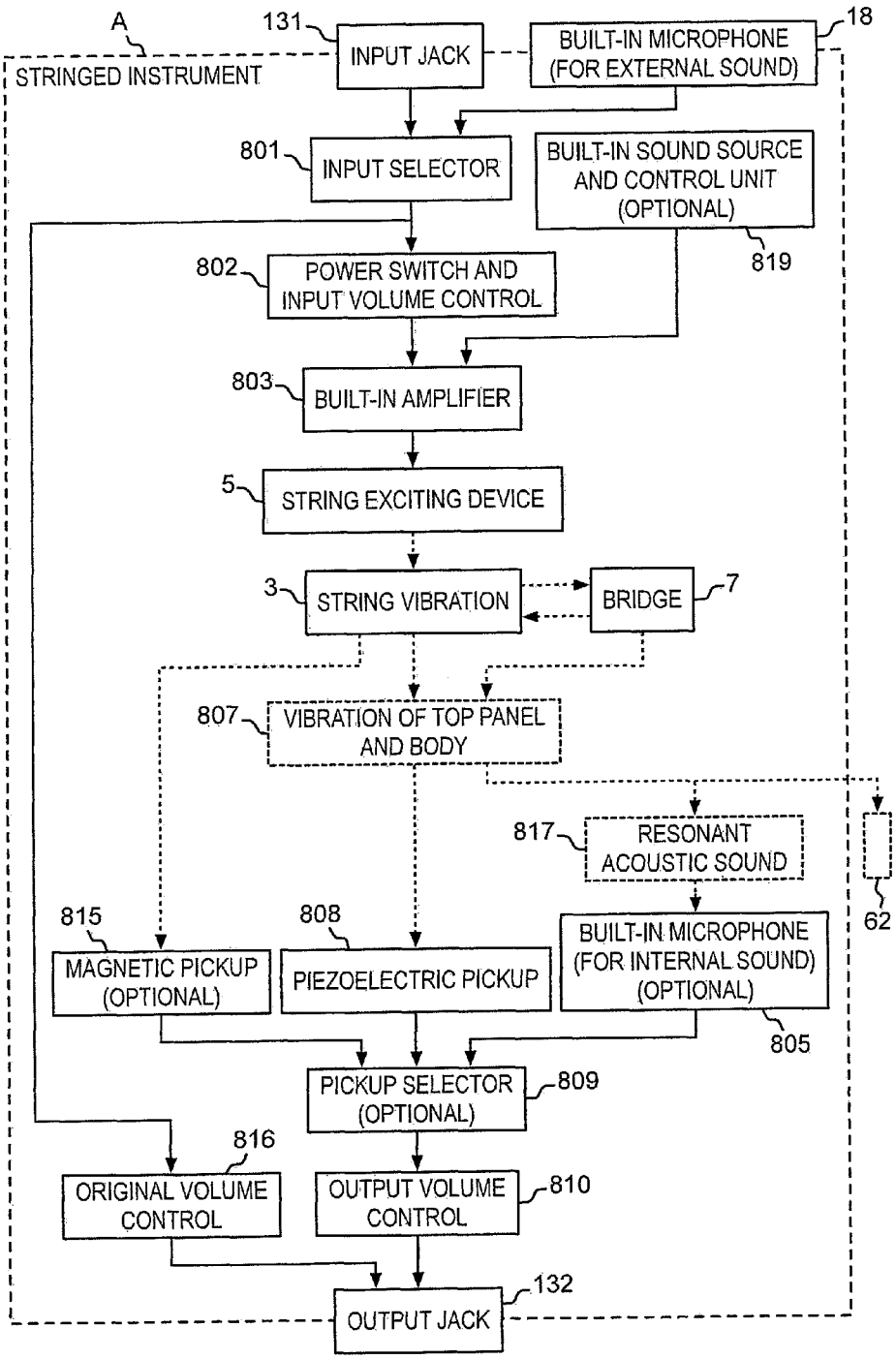
FIG. 37 is a block diagram showing a flow of sound information in the stringed instrument of FIGS. 1 to 33 and its electronic circuit.
Figure 38:
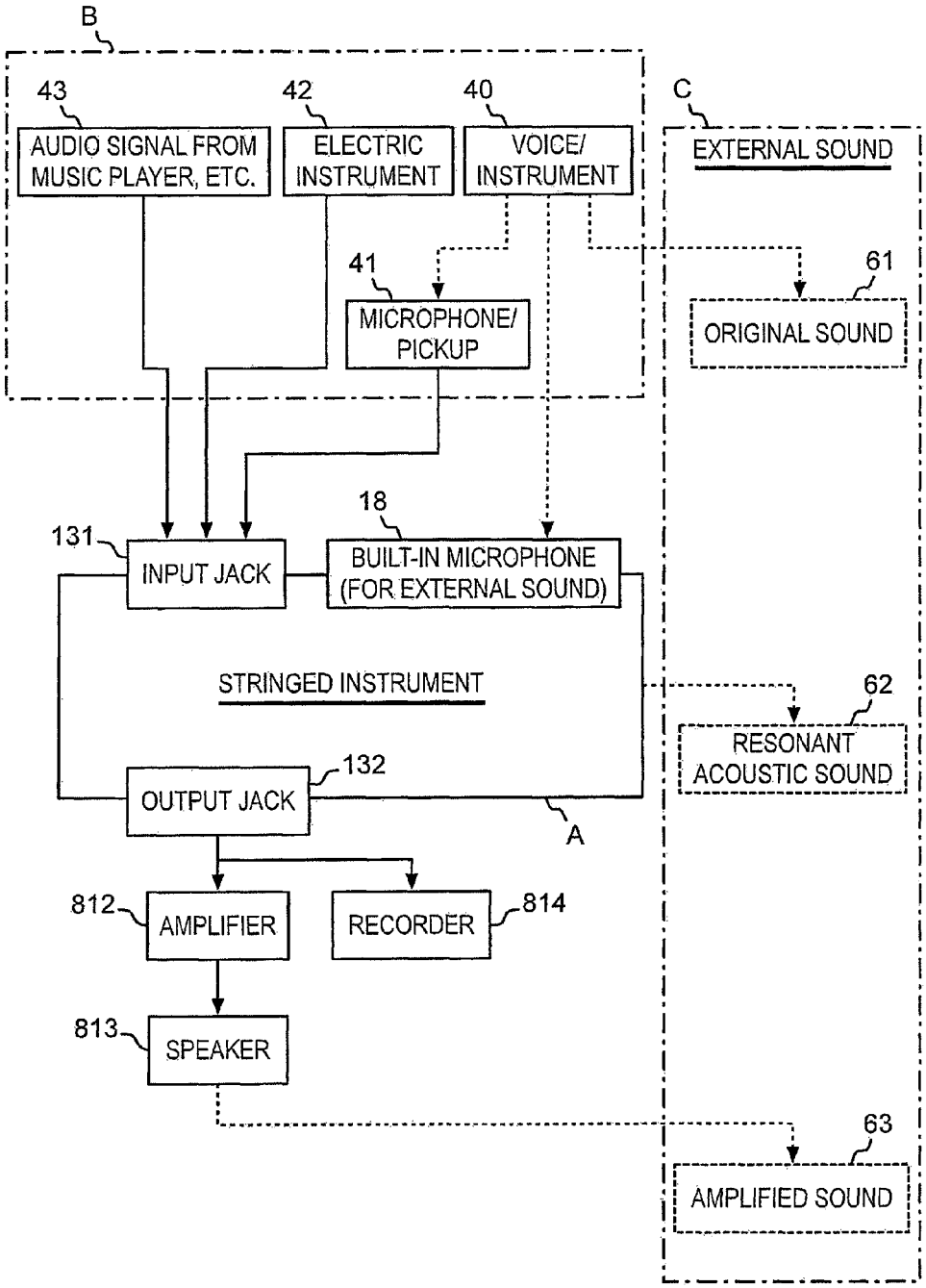
FIG. 38 is a block diagram showing a flow of sound information in the stringed instrument of FIG. 37 and external electrical/electronic circuits.
Figure 39:
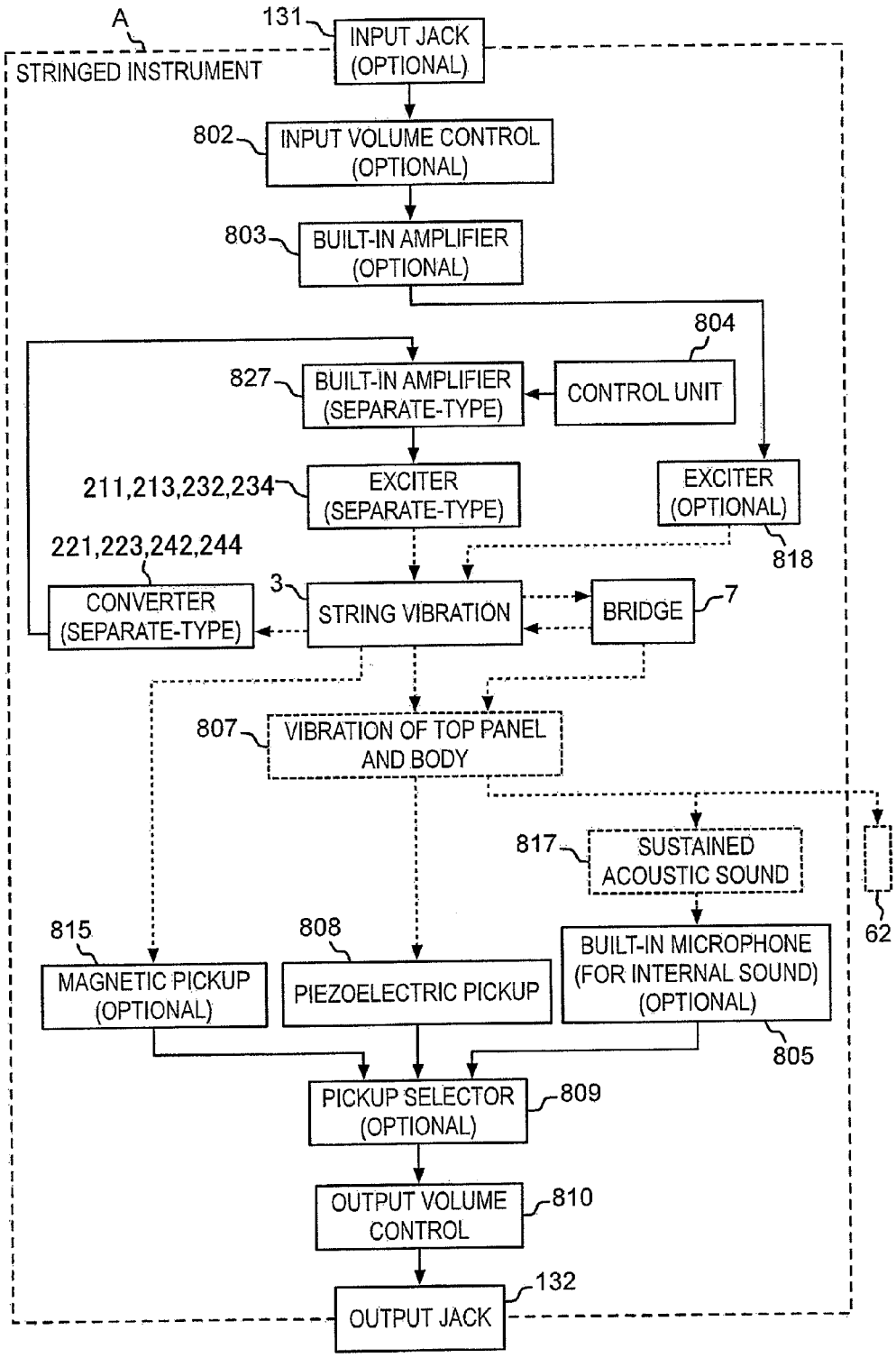
FIG. 39 is a block diagram showing a flow of sound information in the stringed instrument of FIGS. 34 to 36 and its electronic circuit.
Figure 40:
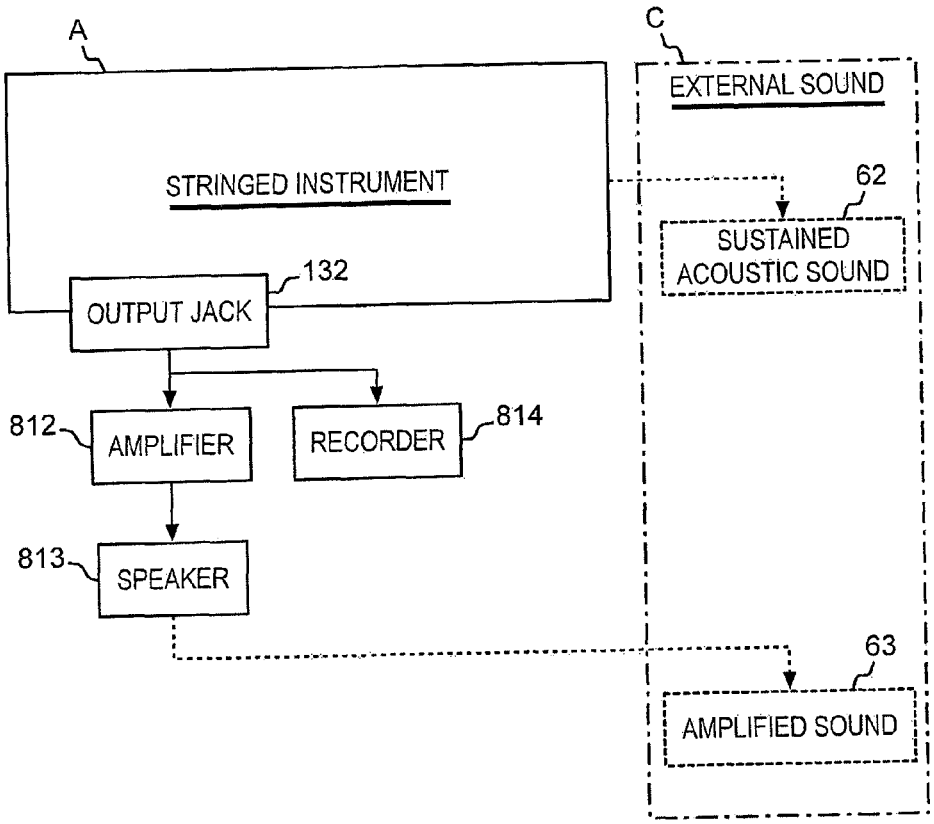
FIG. 40 is a block diagram showing a flow of sound information in the stringed instrument of FIG. 39 and external electrical/electronic circuits.
Figure 41:
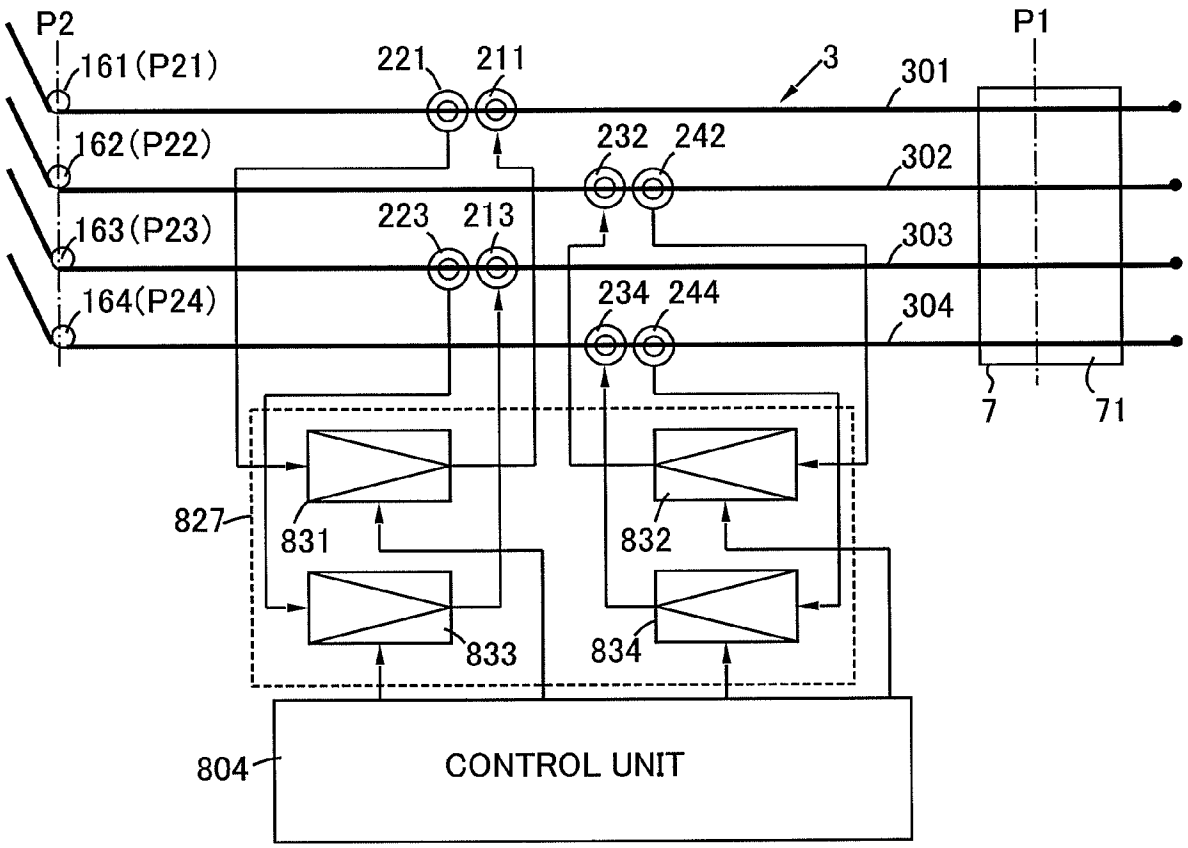
FIG. 41 is a drawing showing a part of the electronic circuit of FIG. 39.

The stringed instrument, according to the present invention has two types of circuit/sound information system: a circuit/sound information system of FIGS. 37 and 38 intended for the stringed instruments shown in FIGS. 1 to 33; a circuit/sound information system of FIGS. 39 to 41 intended for the stringed instrument shown in FIGS. 34 to 36. In FIGS. 37 to 41, an arrow-headed broken line indicates transmission of sound or sound pressure.

(1) Circuit/Sound Information System of FIGS. 37 and 38

FIG. 37 is a block diagram showing a flow of sound information in the stringed instrument of FIGS. 1 to 33 and its electrical/electronic circuit, and FIG. 38 is a block diagram showing a flow of sound information in the stringed instrument, and external electrical/electronic circuits. In the drawings, the symbol A represents a stringed instrument according to the present invention, the symbol B represents an external input device or an input signal, and the symbol C represents an external sound. FIGS. 37 and 38 could be integrated into a single drawing but are separately shown because of space limitations. Hereinbelow, description will be made with reference to FIGS. 37 and 38 and optionally to FIGS. 1 to 33. The stringed instrument of FIGS. 1 to 30 is different, from the stringed instrument of FIGS. 31 to 33 only in that the former generates a resonant sound with higher harmonic components, while the latter generates a reverberant sound. Therefore, attention is mainly focused on the stringed instrument, of FIGS. 1 to 30 for the sake of simplifying the explanation. The stringed instrument of FIGS. 31 to 33 is easy to understand for a person skilled in the art from the description about the stringed instrument of FIGS. 1 to 30.

At first, a sound 40 such as instrumental sound or voice coning from the outside of the stringed instrument is picked up by the built-in microphone 18. When the sound 40 comes from an instrument, having a built-in microphone or pickup 41, sound information can be input from an input, jack 131, instead of being picked up by the built-in microphone 18. When using an electric instrument 42 such as electric guitar or digital piano, sound information can be input from the input jack 131. Also when an audio signal 43 comes from a music player or a personal computer, sound information can be input from the input jack 131.

The choice between the audio signal from the outside and the signal from the built-in microphone 18 is performed by an input selector 801 incorporated in the input jack 131. If a plug for transmitting an audio signal from the outside is put in the input jack 131, the audio signal from the input jack 131 will be chosen. If the plug for transmitting an audio signal from the outside is not put in the input jack 131, on the other hand, the signal from the built-in microphone 18 will be chosen. The input volume of the audio signal coming from the input device and chosen by the input, selector 801 can be controlled by an input volume control 802. After the volume is controlled by the input volume control 802, the audio signal is amplified by a built-in amplifier 803.

The audio signal amplified by the built-in amplifier 803 is sent to the string exciting device 5. Then, the strings 3 are vibrated by the string exciting device 5. When the bridge 7 is a jawari bridge (FIGS. 1 to 30), the vibrating strings 3 come into contact with the surface 71 of the bridge 7 at a plurality of points to generate a resonant sound with higher harmonic components. That is, when the strings 3 resonate and vibrate in response to the excitation signal from the string exciting device 5, the strings 3 come into contact with the surface 71 of the bridge 7 in an intricate manner to add various higher harmonic components to the string vibration, generating a resonant sound with higher harmonic components. Accordingly, even the people who do not have the playing skills can enjoy a resonant sound with higher harmonic components. In addition, since the strings 3 are vibrated by the string exciting device 5, the resonant sound with higher harmonic components can be generated readily and adequately.

In the structure shown in FIGS. 31 to 33, the bridge 7 has the first support point P1 but is configured not to come into contact, with the strings 3 during vibration of the strings 3 at any point between the first support point P1 and the second support, point (P21 to P32), so that even the people who do not have the playing skills can enjoy a reverberant sound generated from the strings 3 resonating at a variety of excitation frequencies applied from the string exciting device 5. Moreover, since the strings 3 are vibrated by the string exciting device 5, the reverberant sound can be generated readily and adequately.

The vibration sound of the strings 3 is transmitted to the top panel 101 and the body 1 and is then emitted as an acoustic sound 62 and also picked up by a piezoelectric pickup 808, controlled by an output volume control 810 and then output from an output jack 132.

Meanwhile, on/off and volume control for the audio signal of the original sound branching off at the input selector 801 is performed by an original volume control 816. When on, it is output from the output jack 132.

The audio signal output from the output jack 132 can be emitted as an amplified sound 63 through an external amplifier 812 and a speaker 813. Alternatively, it can be directly recorded by an external recorder 814.

As a result of the foregoing sound information transmission, when the sound 40 such as instrumental sound or voice is generated, not only the original sound 61 but also the resonant acoustic sound 62 can be emitted in response to the original sound 61. With the external amplifier 812 and the speaker 813, furthermore, the amplified sound 63, in which the original sound is mixed with a resonant sound with higher harmonic components (a reverberant sound in the case of FIGS. 31 to 33), can be emitted. At this time, the mixing ratio can be adjusted freely by operating the original volume control 816 and the output volume, control 810, so that it is also possible to emit only the original sound or a resonant sound with higher harmonic components (a reverberant sound in the case of FIGS. 31 to 33) as the amplified sound 63.

In the case of playing the electric instrument 42 such as electric guitar or digital piano or reproducing the audio signal 43 from a music player or a personal computer, the amplified sound 63, in which the original sound is mixed with a resonant sound with higher harmonic components (a reverberant sound in the case of FIGS. 31 to 33), can be emitted with the external amplifier 812 and the speaker 813. At this time, the mixing ratio can be adjusted freely by operating the original volume control 816 and the output volume control 810, so that it is also possible to emit only the original sound or a resonant sound with higher harmonic components to reverberant sound in the case of FIGS. 31 to 33) as the amplified sound 63. Furthermore, the volume of the amplified sound 63 only of the original sound may be adjusted such that the amplified sound 63 can be heard along with the acoustic sound 62 of a resonant sound with higher harmonic components (a reverberant sound in the case of FIGS. 31 to 33) or the acoustic sound 62 of a resonant sound with higher harmonic components (a reverberant sound in the case of FIGS. 31 to 33) can be heard alone. They can also be recorded by the external recorder 814.

(2) Circuit/Sound Information System of FIGS. 39 to 41

FIGS. 39 and 40 are block diagrams showing a flow of sound information mainly in the stringed instrument of FIGS. 34 to 36 and its electrical/electronic circuit. FIGS. 39 and 40 could be integrated into a single drawing but are separately shown because of space limitations. It should be noted that in FIGS. 39 and 40, only the components relating to the flow of sound information, particularly in the stringed instrument of FIGS. 34 to 36 are shown selectively. In FIGS. 39 and 40, the components corresponding to those shown in FIGS. 37 and 38 are denoted by the same reference symbols, and duplicate explanations are omitted.

Referring to FIGS. 39 and 40 and also to FIGS. 34 to 36, signals from the first to fourth converters 221 to 244 independently facing the strings 301 to 304 are transmitted to the first to fourth exciters 211 to 234 independently facing the same strings through a built-in amplifier 827. The above circuit is a positive feedback oscillator circuit: vibration of strings 3→magnetic pickup (converter with an electromagnetic coil) →built-in amplifier 827→magnetic driver (exciter with an electromagnetic coil)→vibration of strings 3.

With the above oscillator circuit, even when the string 3 is not yet sounded, a noise generated in the positive feedback loop or the like acts as a trigger signal to cause positive feedback, whereby the corresponding one of the strings 301 to 304 starts to vibrate at its resonance frequency. Once the string 3 starts to vibrate, the string vibration sound grows louder until the vibration reaches a certain amplitude. After reaching a certain amplitude, the string vibration is maintained at such a stable state. When the stringed instrument stops to function, the string vibration weakens and the sound stops.

At this time, when the strings 3 are supported by the jawari bridge 7 as shown in FIGS. 34 to 36, a sound with higher harmonic components comes out and grows louder and then continues to sound as a sustained sound with higher harmonic components. When the stringed instrument stops to function, the sound with higher harmonic components weakens naturally and then stops.

With the stringed instrument shown in FIGS. 34 to 36, as described above, even the people who do not have the playing skills can readily and adequately generate a sustained sound with higher harmonic components and enjoy the sustained sound.

Also when the strings 3 are supported by the bridge 7 shown in FIG. 33, they move in basically the same way to generate a sustained sound. In this case, even the people who do not have the playing skills can readily and adequately generate a sustained sound and enjoy the sustained sound.

Built-in amplifiers constituting the built-in amplifier 827 are each controlled by a control unit 804. Start and stop, operation sequence, a signal amplification degree and a period between start and stop of the built-in amplifier 827 can be adjusted by the control unit 804. Its control method is preferably an analog method. However, the control unit 804 may include a CPU (central processing unit) or a MPU (micro-processing unit) for program control of the built-in amplifier 827. For example, the setting of the built-in amplifier 827 by the control unit 804 may be as follows.

(a) All of the strings 301 to 304 or a chosen one continues to sound in a sustained manner.

(b) Start time and stop time are set for the individual strings 301 to 304 to let them continue to sound.

(c) Program is set such that the built-in amplifiers randomly start and stop for the individual strings 301 to 304 to let them continue to sound.

With the above settings (a) to (c), a sustained sound in which higher harmonic components are intricately intertwined together as with the tambura can be generated from strings tuned to desired pitches. Particularly when the strings 301 to 304 are set to sound one after another in a steady rhythm, the resulting sound resembles a sound from the tambura.

FIG. 41 shows a specific circuit configuration of the built-in amplifier 827 and the control unit 804. Referring to this figure, the built-in amplifier 827 has four built-in amplifiers 831 to 834 in accordance with the number of the strings 301 to 304. At first, the built-in amplifier 831 amplifies a string vibration detection signal sent from the converter 221 facing the string 301 and sends the amplified signal to the exciter 211 for vibrating the string 301. The other built-in amplifiers 832 to 834 also amplify a string vibration detection signal sent from the converters 242, 223, 244 facing the strings 302 to 304, respectively, and send the amplified signal to the exciters 232, 213, 234 for vibrating the string 302 to 304, respectively.

In the embodiment shown in FIGS. 34 to 36, the bridge 7 is a jawari bridge, but it should not be construed that the bridge 7 is limited to a jawari bridge. For example, the bridge 7 may have the structure shown in FIG. 33. In this case, people can enjoy a sustained sound due to string vibration, as described above.

5. Modifications

Further modifications may be made in the stringed instrument of the present invention as follow.

(1) Although the stringed instrument shown in FIGS. 1 to 33 generates a resonant sound with higher harmonic components or a reverberant sound in response to a sound from the outside, it is also possible to generate a resonant sound by providing an built-in sound source having a sound chip, e.g., a FM sound source and a control unit 819 for the built-in sound source as shown in FIG. 37 and amplifying an audio signal generated therefrom with the built-in amplifier 803 and sending the amplified signal to the exciting device 5.

With this, for example, a sustained sound can be generated as an acoustic string vibration sound by sending a signal representing the sustained sound from the built-in sound source to resonate a string capable of resonating with the signal. In addition, while such a sustained sound is being generated from the strings 3 by using a signal from the built-in sound source, a resonant sound with higher harmonic components due to string vibration or a reverberant sound can be generated together by using a sound from the outside.

(2) In the stringed instrument shown in FIGS. 1 to 36, not only the piezoelectric pickup 808 having a piezoelectric vibrator but also a built-in microphone 805 for an internal sound and a magnetic pickup 815 having an electromagnetic coil may be employed as means for picking up a sound generated from the stringed instrument according to the present invention, as shown in FIGS. 37 and 39. The built-in microphone 805 for an internal sound detects a sound pressure caused by vibration of the top panel 101 and the body 1. The magnetic pickup 815 detects vibration of the strings 3. In the case where a plurality of devices are provided as means for picking up a sound generated from the stringed instrument according to the present invention, a pickup selector 809 may be provided to decide from which device a signal should be sent to the output volume control 810.

(3) in the embodiment shown in FIGS. 34 to 36, a signal from the outside may be sent to an exciter 818 through the input jack 131, the input volume control 802, the built-in amplifier 803, etc., as shown in FIG. 39. Thus, while the sustained sound is being generated, a resonant sound due to an external sound can be emitted together by using the sound from the outside. Although the exciter 818 is shown separately from the exciters 211, 213, 232, 234, it is also possible to use the exciters 211, 213, 232, 234 as the exciter 818.

Although not shown in the drawings, the elements shown in FIGS. 37 and 38 may be appropriately incorporated into the circuit shown in FIG. 39. The stringed instrument shown in FIGS. 34 to 36 may be combined with the stringed instrument, shown in FIGS. 1 to 33 to share the body 1.

While the present invention has been particularly shown and described with respect to preferred embodiments thereof, it will be understood by those skilled in the art that various changes in form and detail may be made therein without departing from the spirit, scope and teaching of the invention.

What is claimed is:

1. A stringed instrument comprising;

a body, a string, a string exciting device and a bridge, the body supporting the string, the string exciting device and the bridge, the string having a scale length determined by a distance between a first support point and a second support point, the string exciting device being designed to be driven by an electrical signal having a certain frequency and vibrate the string by applying an excitation signal having a frequency corresponding to the frequency of the electrical signal, the bridge has the first support point and a surface located between the first support point and the second support point and designed to come into contact with the string during vibration of the string, the body has an internal space, and the string, the string exciting device and the bridge are disposed in the internal space of the body;

the string and the bridge are disposed on an exterior surface of the body.

2. The stringed instrument of claim 1, wherein the string exciting device includes an exciter for vibrating the string, and a converter for converting its vibration to an electrical signal.

3. The stringed instrument of claim 1, further comprising an electronic circuit capable of supplying an excitation signal to the string exciting device and converting a vibration or a vibration sound generated by the string exciting device to an electrical signal and outputting the electrical signal.

4. The stringed instrument of claim 2, further comprising an electronic circuit capable of supplying an excitation signal to the string exciting device and converting a vibration or a vibration sound generated by the string exciting device to an electrical signal and outputting the electrical signal.

5. The stringed instrument of claim 1 wherein the electric signal to drive the string exciting device is supplied from an outside of the stringed instrument to vibrate the string.

6. The stringed instrument of claim 1 wherein the electric signal to drive the string exciting device is supplied from a built-in microphone.

* * * * *